US008288070B2

(12) United States Patent
Mizuhata et al.

(10) Patent No.: US 8,288,070 B2
(45) Date of Patent: Oct. 16, 2012

(54) PROCESS FOR PRODUCING TONER FOR ELECTROPHOTOGRAPHY

(75) Inventors: Hiroshi Mizuhata, Wakayama (JP); Yutaka Murai, Wakayama (JP); Manabu Suzuki, Wakayama (JP); Hiromi Nambu, Wakayama (JP)

(73) Assignee: Kao Corporation, Tokyo (JP)

( * ) Notice: Subject to any disclaimer, the term of this patent is extended or adjusted under 35 U.S.C. 154(b) by 286 days.

(21) Appl. No.: 12/671,576

(22) PCT Filed: Aug. 6, 2008

(86) PCT No.: PCT/JP2008/064133

§ 371 (c)(1), (2), (4) Date: Feb. 1, 2010

(87) PCT Pub. No.: WO2009/020155

PCT Pub. Date: Feb. 12, 2009

(65) Prior Publication Data

US 2011/0223531 A1 Sep. 15, 2011

(30) Foreign Application Priority Data

| | | |
|---|---|---|
| Aug. 8, 2007 | (JP) | 2007-206878 |
| Oct. 12, 2007 | (JP) | 2007-267118 |
| Feb. 13, 2008 | (JP) | 2008-031727 |
| Feb. 13, 2008 | (JP) | 2008-031732 |

(51) Int. Cl.
*G03G 9/087* (2006.01)

(52) U.S. Cl. ..... 430/137.14; 430/137.16; 430/137.17

(58) Field of Classification Search ..... 430/109.4, 430/110.3, 137.14, 137.17, 137.16
See application file for complete search history.

(56) References Cited

U.S. PATENT DOCUMENTS

| | | | | |
|---|---|---|---|---|
| 5,368,970 | A * | 11/1994 | Grushkin | 430/108.2 |
| 5,416,166 | A | 5/1995 | Yoo et al. | |
| 2006/0210903 | A1* | 9/2006 | Ohki et al. | 430/109.4 |
| 2007/0020542 | A1* | 1/2007 | Patel | 430/108.2 |

FOREIGN PATENT DOCUMENTS

| | | |
|---|---|---|
| JP | 6 506261 | 7/1994 |
| JP | 11 95487 | 4/1999 |
| JP | 2000 292968 | 10/2000 |
| JP | 2004 191532 | 7/2004 |
| JP | 2005 215607 | 8/2005 |
| JP | 2005 215608 | 8/2005 |

OTHER PUBLICATIONS

Office Action issued Jul. 25, 2011 in Chinese Patent Application No. 200880100510.9 (with English translation).

* cited by examiner

*Primary Examiner* — Peter Vajda

(74) *Attorney, Agent, or Firm* — Oblon, Spivak, McClelland, Maier & Neustadt, L.L.P.

(57) ABSTRACT

The present invention relates to a toner for electrophotography which exhibits an excellent heat-resistant storage property and a wide fusing temperature range, and a process for producing the toner for electrophotography. There are provided a process for producing a toner for electrophotography which includes (A) a step of emulsifying a resin binder containing a polyester having a constitutional unit derived from a trivalent or higher-valent carboxylic acid in an aqueous medium; (B) a step of aggregating emulsified particles contained in an emulsion obtained in the step (A); and (C) a step of coalescing aggregated particles obtained in the step (B), said process further including the following steps which are to be conducted after the step (A): (a) a step of adding a compound having at least one functional group selected from the group consisting of an oxazoline group and a glycidyl group; and (b) a step of forming a chemical bond between the compound having the at least one functional group and the resin binder containing the polyester, as well as a toner for electrophotography obtained by the process.

18 Claims, No Drawings

PROCESS FOR PRODUCING TONER FOR ELECTROPHOTOGRAPHY

CROSS REFERENCES TO RELATED APPLICATIONS

This application is a 371 of International Application No. PCT/JP08/64133, filed on Aug. 6, 2008, and claims priority to Japanese Patent Application No. 2007-206878, filed on Aug. 8, 2007, Japanese Patent Application No. 2007-267118, filed on Oct. 12, 2007, Japanese Patent Application No. 2008-031732, filed on Feb. 13, 2008, and Japanese Patent Application No. 2008-031727, filed on Feb. 13, 2008.

TECHNICAL FIELD

The present invention relates to a toner for electrophotography for use in electrophotographic method, electrostatic recording method, electrostatic printing method or the like, and a process for producing the toner.

BACKGROUND ART

In the field of toners for electrophotography, with the progress of electrophotographic systems, it has been demanded to develop toners adaptable for high image quality and high copying speed. From the viewpoint of the high image quality, it has been required that the toners are in the form of finely divided particles and have various properties such as a good heat-resistant storage property and a wide fusing temperature range.

There are conventionally known methods in which the toners are improved in heat-resistant storage property by using a resin having a high glass transition point therein. However, in these methods, the resulting toners tend to be deteriorated in low-temperature fusing ability. Also, in order to ensure a broad fusing temperature range of the toners, it may be effective to increase a content of high-molecular weight components in a resin for the toners. However, in the case of bulk polymerization, it will be difficult to pulverize the resulting resin while inhibiting reduction in a molecular weight of the high-molecular weight components in the resin. In addition, in the method for producing a toner by polycondensation in an aqueous medium, it is substantially difficult to produce a high-molecular weight compound. Further, in the case of an emulsification and aggregation method, etc., there tend to occur problems such as need of a large amount of a solvent or a large mechanical force and occurrence of decomposition of the high-molecular weight compound when emulsified.

There are disclosed a method for enhancing a fusing ability of a toner in which a carbodiimide compound is added to emulsified particles obtained by polycondensation in water to form a chemical bond therebetween on a surface of the respective emulsified particles (Patent Document 1), and a dry toner constituted of toner particles which are obtained by melt-kneading a resin binder having a carboxyl group or an acid anhydride group, a colorant, a specific amount of an oxazoline-based compound having two or more oxazoline groups in a molecule thereof or a resin component containing an oxazoline group, and a releasing agent (Patent Document 2). Also, there is disclosed a toner obtained by a method in which raw materials of the toner including a polyester-containing resin binder and a releasing agent are melt-kneaded together, and then the resulting melt-kneaded material is emulsified in an aqueous medium (Patent Document 3). On the other hand, there has been developed a toner whose surface is treated with an external additive containing two kinds of inorganic particles which are different in particle size from each other in order to enhance a durability and a storage property thereof (Patent Document 4).

Patent Document 1: JP 2006-317715A
Patent Document 2: JP 2000-292968A
Patent Document 3: JP 2007-279195A
Patent Document 4: JP 8-227171A

DISCLOSURE OF THE INVENTION

Problem to be Solved by the Invention

However, with the recent tendency toward high speed and high image quality of copying machines in the field of electrophotography, it has been found that the conventional toners fail to attain a sufficient fusing ability. That is, owing to a shortened fusing time in a fusing step and a lowered heat-fusing temperature in a fusing device, it tends to be very difficult to ensure a sufficient fusing strength of the toners.

If a softening point of the resin binder is lowered or an amount of a releasing agent added is increased to design a toner adaptable to the low-temperature fusing, there tend to occur problems such as high-temperature offset and deteriorated heat-resistant storage property of the toner. Thus, no toners capable of satisfying both a good heat-resistant storage property and a wide fusing temperature range are conventionally known until now.

On the other hand, in the toner produced by using the compound having a carbodiimide group, an oxazoline group, etc., a nitrogen element exhibiting a positive charging property is contained in a structure of these functional groups. Therefore, when such a toner is used as a negative charging toner, a charging property of the toner tends to be insufficient which results in problems such as poor developing property.

The present invention relates to a toner for electrophotography having an excellent heat-resistant storage property and a wide fusing temperature range, and a process for producing such a toner for electrophotography.

Also, the present invention relates to a negative charging toner for electrophotography which exhibits an excellent charging stability, a less fogging on resulting images and an excellent heat-resistant storage property, and a process for producing such a negative charging toner for electrophotography.

Means for Solving Problem

Thus, the present invention relates to:

[1] A process for producing a toner for electrophotography, including:

(A) a step of emulsifying a resin binder containing a polyester having a constitutional unit derived from a trivalent or higher-valent carboxylic acid in an aqueous medium;

(B) a step of aggregating emulsified particles contained in an emulsion obtained in the step (A); and (C) a step of unifying aggregated particles obtained in the step (B), said process further including the following steps which are to be conducted after the step (A):

(a) a step of adding a compound having at least one functional group selected from the group consisting of an oxazoline group and a glycidyl group; and (b) a step of forming a chemical bond between the compound having the at least one functional group and the resin binder containing the polyester;

[2] the process as described in the above [1], wherein the step (A) includes: (1) a step of melt-kneading toner raw materials including the resin binder containing the polyester and a releasing agent together, and (2) a step of emulsifying a melt-kneaded material obtained in the step (1) in an aqueous medium;

[3] the process as described in the above [1] or [2], wherein the process further includes the following step which is to be conducted after the step (C):

(D) a step of subjecting toner particles obtained in the step (C) to external addition treatment with an external additive containing magnesium oxide having a positive charging property and a number-average particle size of from 10 to 200 nm and silica or titanium oxide having a number-average particle size of from 6 to 30 nm; and

[4] a toner for electrophotography which is produced by the process as described in any one of the above [1] to [3].

Effect of the Invention

In accordance with the production process of the present invention, there is provided a toner for electrophotography which exhibits an excellent heat-resistant storage property and a wide fusing temperature range.

Also, in accordance with the production process of the present invention, there is provided a toner for electrophotography which exhibits an excellent charging stability, a less fogging on resulting images, and an excellent heat-resistant storage property.

BEST MODE FOR CARRYING OUT THE INVENTION

<Process for Producing Toner for Electrophotography>

As the method for producing the toner for electrophotography, there may be used various methods such as, for example, a method in which a resin particle composition containing a resin that is dissolved in a solvent in the presence of a compound containing at least one functional group selected from the group consisting of an oxazoline group and a glycidyl group is suspended in water, and then the solvent is distilled off from the suspension to obtain toner particles; an emulsion polymerization and aggregation method in which other materials such as a colorant are added to the resin particles produced by emulsion polymerization in the presence of the compound containing the functional group, and the emulsified particles are aggregated and associated with each other to obtain resin particles; an emulsification and aggregation method in which other materials such as a colorant are added to resin particles obtained by emulsifying a resin binder in the presence of a surfactant, etc., and the resin particles are aggregated and associated with each other to obtain toner particles; and a polymerization method in which toner particles are directly produced by a suspension polymerization method.

The process for producing a toner for electrophotography according to the present invention, includes (A) a step of emulsifying a resin binder containing a polyester having a constitutional unit derived from a trivalent or higher-valent carboxylic acid in an aqueous medium; (B) a step of aggregating emulsified particles contained in an emulsion obtained in the step (A); and (C) a step of unifying aggregated particles obtained in the step (B), said process further including the following steps which are to be conducted after the step (A): (a) a step of adding a compound having at least one functional group selected from the group consisting of an oxazoline group and a glycidyl group (hereinafter occasionally referred to merely as a "functional group-containing compound of the present invention"); and (b) a step of forming a chemical bond between the compound having the at least one functional group and the resin binder containing the polyester.

In the present invention, the process for producing the toner is carried out in the presence of the above functional group-containing compound of the present invention, so that the resulting toner is enhanced in heat-resistant storage property owing to a crosslinking reaction between the compound and a carboxy group of the polyester (crosslinking effect). The method of allowing the functional group-containing compound of the present invention to be present in the reaction system is not particularly limited. However, in the emulsification and aggregation method, it is preferred that after obtaining a dispersion in which the polyester-containing resin binder is emulsified, the functional group-containing compound of the present invention be added to the dispersion. Further, from the viewpoint of exhibiting the crosslinking effect and enhancing a heat-resistant storage property of the resulting toner, it is preferable to heat the reaction system in which the functional group-containing compound of the present invention is present.

[Step (A)]

In the process for producing a toner for electrophotography according to the present invention, first, in the step (A), the resin binder containing a polyester having a constitutional unit derived from a trivalent or higher-valent carboxylic acid is emulsified in an aqueous medium.

(Resin Binder Containing Polyester)

The resin binder preferably contains a polyester from the viewpoints of a good fusing ability and a good durability of the resulting toner. The polyester has a constitutional unit derived from a trivalent or higher-valent carboxylic acid, in particular, a branched polyester having a branched structure is preferred. The content of the polyester in the resin binder is preferably 60% by weight or more, more preferably 70% by weight or more, even more preferably 80% by weight or more and further even more preferably substantially 100% by weight from the viewpoints of a good fusing ability and a good durability of the resulting toner. The polyester may be either a crystalline polyester or a non-crystalline polyester.

Examples of resins other than the polyester which may be contained in the resin binder include known resins conventionally used for toners such as styrene-acryl copolymers, epoxy resins, polycarbonates and polyurethanes.

As the raw monomers of the polyester, there may be used known monomers. The monomers used in the present invention include at least a trivalent or higher-valent carboxylic acid component and preferably further include a trivalent or higher-valent alcohol component, or include both of the trivalent or higher-valent carboxylic acid component and the trivalent or higher-valent alcohol component.

Examples of the trivalent or higher-valent carboxylic acid include polycarboxylic acids such as trimellitic acid, 2,5,7-naphthalene-tricarboxylic acid and pyromellitic acid; and anhydrides and alkyl ($C_1$ to $C_3$) esters of these acids. Among these acids, from the viewpoint of a good condensation reactivity, preferred is trimellitic acid.

Examples of the trivalent or higher-valent alcohol include glycerol, pentaerythritol, trimethylol propane, sorbitol, and alkylene ($C_2$ to $C_4$) oxide adducts (average molar number of addition: 1 to 16) of these alcohols.

As the other monomer components, there may be used any of known alcohol components and known carboxylic acid components such as carboxylic acids, carboxylic anhydrides and carboxylic esters.

As the other carboxylic acid component, there may be used divalent carboxylic acids. Specific examples of the divalent carboxylic acids include dicarboxylic acids such as phthalic acid, isophthalic acid, terephthalic acid, sebacic acid, fumaric acid, maleic acid, adipic acid, azelaic acid, succinic acid and cyclohexanedicarboxylic acid; succinic acids substituted with an alkyl group having 1 to 20 carbon atoms or an alkenyl group having 2 to 20 carbon atoms such as dodecylsuccinic acid, dodecenylsuccinic acid and octenylsuccinic acid; and anhydrides and alkyl ($C_1$ to $C_3$) esters of these acids. These carboxylic acids may be used alone or in combination of any two or more thereof.

As the other alcohol component, there may be used divalent alcohols. Specific examples of the divalent alcohol include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane, hydrogenated bisphenol A, ethylene glycol, propylene glycol, neopentyl glycol, 1,4-butanediol, 1,3-butanediol, 1,6-hexanediol, and alkylene ($C_2$ to $C_4$) oxide adducts (average molar number of addition: 1 to 16) of these alcohols. These alcohols may be used alone or in combination of any two or more thereof.

In the resin binder used in the toner for electrophotography according to the present invention, from the viewpoint of effectively forming a crosslinking structure therein, the content of the trivalent or higher-valent carboxylic acid in the carboxylic acid component as the raw monomers of the polyester is preferably 1% by weight or more, more preferably 2% by weight or more and even more preferably 3% by weight or more on the basis of a total weight of the carboxylic acid component. Also, the content of the trivalent or higher-valent carboxylic acid in the carboxylic acid component is preferably 80% by weight or less, more preferably 50% by weight or less and even more preferably 40% by weight or less. That is, the content of the trivalent or higher-valent carboxylic acid components in the carboxylic acid component is preferably from 1 to 80% by weight, more preferably from 2 to 50% by weight and even more preferably from 3 to 40% by weight on the basis of the total weight of the carboxylic acid component. Therefore, the content of the constitutional unit derived from the trivalent or higher-valent carboxylic acid in the polyester also corresponds to the above content of the trivalent or higher-valent carboxylic acid in the carboxylic acid component. Meanwhile, the amount of the constitutional unit derived from the trivalent or higher-valent carboxylic acid in the polyester may be measured by various analyzing methods, for example, by a nuclear magnetic resonance (NMR) spectroscopic method.

The polyester may be produced, for example, by polycondensing the alcohol component and the carboxylic acid component in an inert gas atmosphere at a temperature of about 180 to about 250° C. by using an esterification catalyst, if required.

Examples of the esterification catalyst usable in the above reaction include tin compounds such as dibutyl tin oxide and tin dioctylate, and titanium compounds such as titanium diisopropylate bistriethanol aminate. The amount of the esterification catalyst used is preferably from 0.01 to 1 part by weight and more preferably from 0.1 to 0.6 part by weight on the basis of 100 parts by weight of a sum of the alcohol component and the carboxylic acid component.

These polyesters may be used alone or in combination of any two or more thereof, in the resin binder.

Meanwhile, in the present invention, as the polyester, there may be used not only unmodified polyesters but also modified polyesters obtained by modifying polyesters to such an extent that the polyesters are substantially free from deterioration in properties thereof. However, in the present invention, the unmodified polyesters are preferably used. Examples of the modified polyesters include polyesters grafted or blocked with phenol, urethane, epoxy, etc., by the methods described, for example, in JP 11-133668A, JP 10-239903A and JP 8-20636A, and composite resins containing two or more kinds of resin units including a polyester unit.

From the viewpoint of a good heat-resistant storage property of the resultant toner, the polyester preferably has a softening point of 70 to 165° C. and a glass transition point of 50 to 85° C. Also, the polyester preferably contains an acid group. The acid value of the polyester is preferably from 6 to 35 mg KOH/g, more preferably from 10 to 35 mg KOH/g and even more preferably from 15 to 35 mg KOH/g from the viewpoint of facilitated production of the emulsion. The softening point or the acid value of the polyester may be desirably adjusted by controlling the temperature and time, etc., used in the polycondensation reaction.

From the viewpoint of a good durability of the resultant toner, the number-average molecular weight of the polyester is preferably from 1,000 to 50,000, more preferably from 1,000 to 10,000 and even more preferably from 2,000 to 8,000.

Meanwhile, when the resin binder is composed of a plurality of resins, the softening point, glass transition point, acid value and number-average molecular weight of the resin binder all mean those characteristic values of a mixture of these resins. The respective characteristic values of the mixture are preferably the same as the corresponding values of the polyesters.

Further, from the viewpoints of a good fusing ability and a good durability of the toner, the resin binder may contain two kinds of polyesters which are different in softening point from each other in which one polyester (a) preferably has a softening point of not lower than 70 and lower than 115° C., and the other polyester (b) preferably has a softening point of from 115 to 165° C. The weight ratio of the polyester (a) to the polyester (b) (a/b) in the resin binder is preferably from 10/90 to 90/10 and more preferably from 50/50 to 90/10.

(Aqueous Medium)

The aqueous medium used for emulsifying the resin binder (also referred to merely as the resin) contains water as a main component. From the viewpoint of a good environmental suitability, the water content in the aqueous medium is preferably 80% by weight or more, more preferably 90% by weight or more, even more preferably 95% by weight or more, and further even more preferably 100% by weight.

Examples of components other than water which may be contained in the aqueous medium include water-soluble organic solvents such as methanol, ethanol, isopropanol, butanol, acetone, methyl ethyl ketone and tetrahydrofuran. Among these organic solvents, from the viewpoint of less inclusion into the toner, preferred are alcohol-based organic solvents incapable of dissolving the resin therein such as methanol, ethanol, isopropanol and butanol. In the present invention, the resin binder is preferably finely dispersed in water solely substantially without using any organic solvent, to form fine particles thereof.

(Emulsification of Resin Binder Containing Polyester)

In the present invention, first, the emulsified particles (also referred to as "resin particles") which contains the resin binder containing the polyester are produced in the aqueous medium. The emulsified dispersion containing the resin particles (also referred to as a "resin dispersion") is preferably produced by emulsifying the resin binder in the aqueous medium from the viewpoints of reduction in particle size of the resin particles and a uniform particle size distribution of the resulting toner.

The resin particles contained in the resin emulsion obtained by emulsifying the resin binder in the aqueous medium may contain, in addition to the resin binder, various optional additives such as a colorant, a releasing agent, a charge control agent, a reinforcing filler such as fibrous substances, an antioxidant and an anti-aging agent, if required.

The colorant is not particularly limited, and all of the known colorants may be used. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes, thiazole dyes and xanthene dyes. These colorants may be used alone or in combination of any two or more thereof.

The content of the colorant in the resin particles is preferably 20 parts by weight or less and more preferably from 0.01 to 10 parts by weight on the basis of 100 parts by weight of the resin binder.

Examples of the releasing agent include low-molecular weight polyolefins such as polyethylene, polypropylene and polybutene; silicones exhibiting a softening point upon heating; fatty acid amides such as oleamide, erucamide, ricinolamide and stearamide; vegetable waxes such as carnauba wax, rice wax, candelilla wax, haze wax and jojoba oil; animal waxes such as beeswax; mineral and petroleum waxes such as montan wax, ozokerite, ceresin, paraffin wax, microcrystalline wax and Fischer-Tropsch wax; and the like. These releasing agents may be used alone or in combination of any two or more thereof.

The releasing agent may be added to the reaction system in the step (A), the step (B), etc. In the present invention, as described hereinlater, it is preferred that the releasing agent be previously melt-kneaded together with the resin binder, etc., and then emulsified therewith in the step (A) from the viewpoints of a good fusing ability and a good heat-resistant storage property of the resulting toner.

The content of the releasing agent in the resin particles is usually from about 1 to about 20 parts by weight and preferably from 2 to 15 parts by weight on the basis of 100 parts by weight of the resin binder, or on the basis of 100 parts by weight of a sum of the resin binder and the colorant, if used, in view of attaining good effects due to addition thereof and preventing adverse influence on a charging property of the toner.

Examples of the charge control agent include metal salts of benzoic acid, metal salts of salicylic acid, metal salts of alkylsalicylic acids, metal salts of catechol, metal (such as chromium, iron and aluminum)-containing bisazo dyes, tetraphenyl borate derivatives, quaternary ammonium salts and alkyl pyridinium salts.

The content of the charge control agent in the resin particles is preferably 10 parts by weight or less and more preferably from 0.01 to 5 parts by weight on the basis of 100 parts by weight of the resin binder.

In the present invention, when emulsifying the resin binder containing the polyester in the aqueous medium, from the viewpoints of an enhanced emulsification stability of the resin binder, a good heat-resistant storage property of the resulting toner, etc., a surfactant is allowed to be present in the reaction system in an amount of preferably 10 parts by weight or less, more preferably 5 parts by weight or less, even more preferably from 0.1 to 3 parts by weight and further even more preferably from 0.5 to 2 parts by weight on the basis of 100 parts by weight of the resin binder.

Examples of the surfactant include anionic surfactants such as sulfate-based surfactants, sulfonate-based surfactants, phosphate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. The nonionic surfactant is preferably used in combination with the anionic surfactant or the cationic surfactant. These surfactants may be used alone or in combination of any two or more thereof.

Specific examples of the anionic surfactants include dodecylbenzenesulfonic acid, sodium dodecylbenzenesulfonate, sodium dodecylsulfate, sodium alkylethersulfates, sodium alkylnaphthalenesulfonates and sodium dialkylsulfosuccinates. Among these anionic surfactants, preferred is sodium dodecylbenzenesulfonate.

Specific examples of the cationic surfactants include alkylbenzenedimethyl ammonium chlorides, alkyltrimethyl ammonium chlorides and distearyl ammonium chloride.

Examples of the nonionic surfactants include polyoxyethylene alkyl aryl ethers or polyoxyethylene alkyl ethers such as polyoxyethylene nonylphenyl ether, polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty esters such as polyethylene glycol monolaurate, polyethylene glycol monostearate and polyethylene glycol monooleate; and oxyethylene/oxypropylene block copolymers.

In the emulsification step, an aqueous alkali solution is preferably added to the resin binder to disperse the resin binder together with optional additives therein.

The aqueous alkali solution used for dispersing the resin binder preferably has a concentration of from 1 to 20% by weight, more preferably from 1 to 10% by weight and even more preferably from 1.5 to 7.5% by weight. As the alkali of the aqueous alkali solution, there may be used such an alkali which allows a salt of the alkali and the polyester to exhibit an enhanced surface activity. Specific examples of the alkali include hydroxides of a monovalent alkali metal such as potassium hydroxide and sodium hydroxide.

After dispersing the resin binder, if required, together with the other optional additives, in the aqueous alkali solution, the resulting dispersion is preferably neutralized at a temperature not lower than a glass transition point of the resin binder. Thereafter, an aqueous medium is added to the dispersion at a temperature not lower than the glass transition point of the resin binder to emulsify the resin binder, thereby preparing the resin emulsion.

The rate of addition of the aqueous medium is preferably from 0.1 to 50 g/min, more preferably from 0.5 to 40 g/min and even more preferably from 1 to 30 g/min per 100 g of the resin from the viewpoint of efficiently conducting the emulsifying step. The rate of addition of the aqueous medium may be generally maintained until an O/W type emulsion is substantially formed. Therefore, the rate of addition of the aqueous medium after forming the O/W type emulsion is not particularly limited.

Examples of the aqueous medium used upon production of the resin emulsion include the same aqueous media as described above. Among these aqueous media, preferred are deionized water and distilled water.

The amount of the aqueous medium used is preferably from 100 to 2,000 parts by weight and more preferably from 150 to 1,500 parts by weight on the basis of 100 parts by weight of the resin binder from the viewpoint of obtaining uniform aggregated particles in the subsequent aggregating treatment. The amount of the aqueous medium used is controlled such that the solid content of the thus prepared resin emulsion preferably lies in the range of from 7 to 50% by weight, more preferably from 7 to 40% by weight and even more preferably from 10 to 30% by weight, from the viewpoints of a good stability and a good handling property of the resulting resin emulsion. Meanwhile, the solid components contained in the resin emulsion may include nonvolatile components such as the resins and nonionic surfactants.

From the viewpoint of preparing a resin emulsion containing fine resin particles, the above emulsification is preferably conducted at a temperature not lower than the glass transition point of the resin binder and not higher than the softening point thereof. When the emulsification is conducted in the above-specified temperature range, the resin binder can be smoothly emulsified in the aqueous medium, and any special apparatus is not required therefor. From these viewpoints, the temperature used for the emulsification is preferably a temperature not lower than the "glass transition point of the resin binder+(plus)10° C." (this means a "temperature higher by 10° C. than the glass transition point of the resin binder"; hereinafter, the similar expression should be construed to have the similar meaning), but a temperature not higher than the "softening point of the resin binder−(minus)5° C.".

The volume-median particle size ($D_{50}$) of the resin particles contained in the thus obtained resin emulsion is preferably from 0.02 to 2 μm, more preferably from 0.05 to 1 μm and even more preferably from 0.05 to 0.6 μm for the purpose of uniform aggregation thereof in the subsequent aggregating step. Meanwhile, the volume-median particle size ($D_{50}$) as used herein means a particle size at which a cumulative volume frequency calculated on the basis of a volume fraction of particles from a smaller particle size side thereof is 50%.

As an alternative method for obtaining the resin emulsion by emulsifying the resin binder in the aqueous medium, there may be used, for example, the method of emulsifying and dispersing polycondensable monomers as raw materials of the aimed resin particles in an aqueous medium, for example, by applying a mechanical shearing force or an ultrasonic wave thereto. In this method, if required, additives such as a polycondensation catalyst and a surfactant may also be added to the aqueous medium. The polycondensation reaction of the monomers is allowed to proceed, for example, by heating the thus obtained solution. For example, when using a polyester as the resin binder, there may be used the polycondensable monomers and the polycondensation catalysts for polyesters as described above, and as the surfactant, there may also be used those as described above.

The polymerization of the polycondensable monomers for producing the polycondensed resin is usually accompanied with a dehydration reaction thereof and, therefore, does not principally proceed in the aqueous medium. However, for example, when the polycondensable monomers are emulsified in the aqueous medium in the presence of a surfactant capable of forming a micelle in the aqueous medium, the monomers are present in a micro hydrophobic site in the micelle and subjected to dehydration reaction therein to produce water. By discharging the thus produced water into the aqueous medium outside of the micelle, the polymerization of the monomers can proceed. Thus, it is possible to produce the aimed dispersion containing the resin particles obtained by polycondensation and emulsified and dispersed in the aqueous medium, even under an energy saving condition.

(Melt-Kneading of Raw Materials for Toner Including Polyester-Containing Resin Binder and Releasing Agent)

From the viewpoints of a good fusing ability and a good heat-resistant storage property of the toner, the step (A) preferably includes (1) a step of melt-kneading raw materials for toner which include the resin binder containing the polyester and the releasing agent, and (2) a step of emulsifying a melt-kneaded material obtained in the step (1) in the aqueous medium.

In the present invention, the melt-kneaded material obtained by melt-kneading the raw materials such as the resin binder and the releasing agent is preferably emulsified in the aqueous medium. Thus, by previously producing the melt-kneaded material of the raw materials, the releasing agent is enhanced in dispersibility in the polyester.

When producing the toner by a chemical method, the releasing agent tends to have a low solubility and, therefore, exhibit a poor dispersibility. In particular, in the emulsification and aggregation method, no mechanical shear force is applied in the process for production of the toner unlike the conventional melt-kneading method, so that the releasing agent may fail to be uniformly dispersed in the toner to a sufficient extent. The releasing agent that is non-uniformly dispersed in the toner tends to be isolated therefrom during production of the toner or exposed to a surface of the toner, so that the resulting toner tends to exhibit a narrowed fusing temperature range or to be insufficient in heat-resistant storage property. In addition, the high-molecular weight components of the resin binder tend to be insufficiently emulsified, so that the toner obtained by subjecting the resulting emulsion to aggregation, etc., tends to be insufficient in heat-resistant storage property and fusing ability.

It is considered that when the raw materials such as the resin binder and the releasing agent are melt-kneaded together before emulsified, the releasing agent is well dispersed in the resin binder, and when such a melt-kneaded material is emulsified, the resulting emulsified particles are constituted from the resin enclosing the releasing agent therein. However, when the emulsified particles are subjected to aggregating and coalescing steps, the releasing agent tends to be isolated from the aggregated particles upon heating in the coalescing step, so that the resulting toner tends to exhibit a poor fusing ability because of failure to incorporate a desired amount of the releasing agent in the toner, or tends to be deteriorated in heat-resistant storage property owing to exposure of the releasing agent to a surface of the toner. On the contrary, in the present invention, the functional group-containing compound of the present invention is added after the emulsifying step. Therefore, the polyester contained in the resin binder is crosslinked with the functional group-containing compound of the present invention, for example, when heated in the coalescing step, so that the resin binder present on the aggregated particles undergoes crosslinking or the resin particles within the aggregated particles are crosslinked with each other to thereby form a strongly bonded aggregate. As a result, it is suggested that the releasing agent can be prevented from being isolated from the aggregated particles, and the resulting toner can be further enhanced in fusing ability and heat-resistant storage property by the combined effect of the less isolation of the releasing agent from the aggregates and an influence of change in thermal properties of the resin binder owing to the crosslinking.

Step (1)

In the step (1), the raw materials for toner including the resin binder containing the polyester and the releasing agent are melt-kneaded together.

Examples of the releasing agent used in the step (1) include paraffin waxes, micro waxes, rice waxes, fatty acid amide-based waxes, fatty acid-based waxes, aliphatic monoketones, fatty acid metal salt-based waxes, fatty acid ester-based waxes, partially saponified fatty acid ester-based waxes, silicone varnishes, higher alcohols and carnauba waxes, as well as polyolefins such as low-molecular weight polyethylene and polypropylene. These releasing agents may be used alone or in combination of any two or more thereof.

The melting point of the releasing agent is preferably from 60 to 90° C. and more preferably from 65 to 90° C. from the viewpoint of a good fusing ability of the resulting toner. Among these releasing agents, from the viewpoint of a good low-temperature fusing ability of the resulting toner, preferred are paraffin waxes having a melting point of from 60 to 90° C., whereas from the viewpoint of a good compatibility with the polyester, preferred are ester-based waxes having a melting point of from 60 to 90° C., and more preferred is carnauba waxes.

Meanwhile, the melting point of the releasing agent may be determined by differential scanning calorimetry (DSC). More specifically, the melting point of the releasing agent may be determined as a melting peak value observed when several milligrams of a sample are heated at a predetermined temperature rise rate, for example, at a rate of 10° C./min. The content of the releasing agent is preferably from 0.5 to 20 parts by weight, more preferably from 1 to 20 parts by weight, even more preferably from 1 to 18 parts by weight and further even more preferably from 1.5 to 15 parts by weight on the basis of 100 parts by weight of the resin binder from the viewpoints of a good dispersibility in the resin binder and a good fusing ability of the resulting toner.

Before being melt-kneaded in the step (1), the respective raw materials are preferably uniformly mixed with each other by any mechanical method. More specifically, the mixing step in which the toner components including the resin binder containing the polyester and the releasing agent, if required, together with a colorant, a charge control agent, etc., are mechanically mixed with each other, may be carried out under ordinary conditions using an ordinary mixer having an agitation blade. The mechanical method used in the mixing step is not particularly limited.

After completion of the mixing step, the resulting mixture is charged into a kneader and melt-kneaded therein. The melt-kneading procedure must be carried out under appropriate conditions so as not to induce breakage of molecular chains of the resin binder and excessive dispersion of the charge control agent and the releasing agent. More specifically, the melt-kneading temperature must be determined by taking into consideration a softening point of the resin binder and a melting point of the releasing agent. When the melt-kneading temperature is too low as compared to the softening point of the resin binder, breakage of molecular chains of the resin binder tends to occur violently. When the melt-kneading temperature is too high, the charge control agent and the releasing agent tend to be hardly dispersed. More specifically, from these viewpoints, the heating temperature upon the melt-kneading is preferably from 70 to 200° C. and more preferably from 80 to 200° C.

As the melt-kneader for carrying out the above melt-kneading procedure, there may be used a single- or twin-screw continuous kneader, a roll mill-type batch kneader and an open roll-type kneader. Among these kneaders, preferred is any of a twin-screw continuous kneader, a roll mill-type batch kneader and an open roll-type kneader. Examples of the suitable kneaders include a KTK-type twin-screw extruder available from Kobe Steel Ltd., a TEM-type extruder available from Toshiba Machine Co., LTD, a twin-screw extruder available from K.C.K. Inc., a co-kneader available from Buss AG, a PCM-type twin-screw extruder available from Ikegai K. K., and an open roll-type continuous kneader. Among these kneaders, from the viewpoint of a good dispersibility of the releasing agent, preferred are a twin-screw extruder and an open roll-type kneader, and more preferred is an open roll-type kneader. The preferred twin-screw extruder is a PCM-type twin-screw extruder available from Ikegai K. K., whereas the preferred open roll-type kneader is an open roll-type kneader available from Mitsui Mining Co., Ltd.

The open roll-type kneader is equipped with at least two rolls and has a melt-kneading section of an open roll type. In the present invention, a kneader equipped with at least two rolls including a heating roll and a cooling roll is preferably used. Such an open roll-type kneader is capable of readily releasing a kneading heat generated upon the melt-kneading. Also, the open roll-type kneader is preferably of an continuous type from the viewpoint of a high productivity.

Further, in the open roll-type twin-screw kneader, the two rolls are arranged close to and parallel with each other in which a clearance between the rolls is preferably from 0.01 to 5 mm and more preferably from 0.05 to 2 mm. The structure, size, material, etc., of the respective rolls are not particularly limited, and the surface of the respective rolls may be either smooth, wavy or irregular.

The rotating speed, i.e., peripheral speed, of the rolls is preferably from 2 to 100 m/min. The peripheral speed of the cooling roll is preferably from 2 to 100 m/min, more preferably from 10 to 60 m/min and even more preferably from 15 to 50 m/min. In addition, the two rolls are preferably different in peripheral speed from each other such that a ratio between the peripheral speeds of the two rolls (cooling roll/heating roll) is preferably from 1/10 to 9/10 and more preferably from 3/10 to 8/10.

In order to facilitate attachment of the kneaded material onto the heating roll, it is preferred that the temperature of the heating roll be adjusted to a temperature higher than any of the softening point of the resin binder and the melting point of the releasing agent, whereas the temperature of the cooling roll be adjusted to a temperature lower than any of the softening point of the resin binder and the melting point of the releasing agent. More specifically, the temperature of the heating roll is preferably from 80 to 200° C., whereas the temperature of the cooling roll is preferably from 20 to 140° C.

The difference between the temperatures of the heating and cooling rolls is preferably from 60 to 150° C. and more preferably from 80 to 120° C.

Meanwhile, the temperature of the respective rolls may be controlled, for example, by adjusting a temperature of a heating medium which passes through an inside of each roll. The inside of each roll may be divided into two or more parts to allow heating media having different temperatures to pass through the respective parts.

The temperature of the heating roll, in particular, its portion located on a raw material charging side, is preferably higher than any of the softening point of the resin binder and the melting point of the releasing agent, more preferably higher by from 0 to 80° C. and even more preferably higher by from 5 to 50° C., than a higher one of the softening point of the resin binder and the melting point of the releasing agent. Whereas, the temperature of the cooling roll is preferably lower than any of the softening point of the resin binder and the melting point of the releasing agent, more preferably lower by from 0 to 80° C. and even more preferably lower by from 40 to 80° C., than a lower one of the softening point of the resin binder and the melting point of the releasing agent.

Step (2)

In the step (2), the melt-kneaded material obtained in the step (1) is emulsified in the aqueous medium. The step (2) may be carried out in the same manner as described in the above paragraph "Emulsification of Resin Binder Containing Polyester" except for using the melt-kneaded material obtained in the step (1) in place of the resin binder.

[Step (B)]

In the step (B), the emulsified particles contained in the emulsion obtained in the preceding step (A) are aggregated together.

In the aggregating step, in order to effectively carry out the aggregation, an aggregating agent is added. Examples of the aggregating agent used in the present invention include organic aggregating agents such as a cationic surfactant in the form of a quaternary salt and polyethyleneimine, and inorganic aggregating agents such as an inorganic metal salt, an inorganic ammonium salt and a divalent or higher-valent metal complex. The inorganic metal salts include, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly (aluminum chloride), poly(aluminum hydroxide) and calcium polysulfide. Specific examples of the inorganic ammonium salts include ammonium sulfate, ammonium chloride and ammonium nitrate.

Among these aggregating agents, from the viewpoint of controlling a particle size of the toner with a high accuracy and achieving a sharp particle size distribution thereof, a monovalent salt is preferably used. The "monovalent salt" as used herein means that a valence of a metal ion or an cation constituting the salt is 1. Examples of the monovalent salt as the aggregating agent include organic aggregating agents such as cationic surfactants in the form of a quaternary salt, and inorganic aggregating agents such as inorganic metal salts and ammonium salts. In the present invention, among these aggregating agents, water-soluble nitrogen-containing compounds having a molecular weight of 350 or less are preferably used.

The water-soluble nitrogen-containing compounds having a molecular weight of 350 or less are preferably acidic compounds in order to rapidly aggregate the primary particles. The pH value of an aqueous solution containing 10% by weight of the water-soluble nitrogen-containing compound is preferably from 4 to 6 and more preferably from 4.2 to 6 as measured at 25° C. Also, from the viewpoints of a good charging property under high-temperature and high-humidity conditions, etc., the water-soluble nitrogen-containing compounds preferably have a molecular weight of 350 or less and more preferably 300 or less. Examples of the water-soluble nitrogen-containing compounds include ammonium salts such as ammonium halides, ammonium sulfate, ammonium acetate, ammonium benzoate and ammonium salicylate; and quaternary ammonium salts such as tetraalkyl ammonium halides. From the viewpoint of a good productivity, among these compounds, preferred are ammonium sulfate (pH value of 10 wt % aqueous solution at 25° C. (hereinafter referred to merely as a "pH"): 5.4), ammonium chloride (pH: 4.6), tetraethyl ammonium bromide (pH: 5.6) and tetrabutyl ammonium bromide (pH: 5.8).

The amount of the aggregating agent used is preferably 50 parts by weight or less, more preferably 40 parts by weight or less and even more preferably 30 parts by weight or less on the basis of 100 parts by weight of the resin binder from the viewpoint of a good charging property, in particular, under high-temperature and high-humidity conditions, and is preferably 1 part by weight or more, more preferably 3 parts by weight or more, and even more preferably 5 parts by weight or more on the basis of 100 parts by weight of the resin binder from the viewpoint of a good aggregating property. From these viewpoints, the amount of the monovalent salt used is preferably from 1 to 50 parts by weight, more preferably from 3 to 40 parts by weight and even more preferably from 5 to 30 parts by weight on the basis of 100 parts by weight of the resin binder.

The aggregating agent is added, after suitably controlling the pH value of the reaction system, at a temperature not higher than the "glass transition temperature of the resin binder+(plus)20° C.", preferably not higher than the "glass transition temperature of the resin binder+(plus)10° C." and more preferably lower than the "glass transition temperature of the resin binder+(plus)5° C.". When adding the aggregating agent at the above-specified temperature, it is possible to obtain aggregated particles having a narrow particle size distribution and a uniform particle size. In addition, the addition of the aggregating agent is preferably carried out at a temperature preferably not lower than the "softening point of the resin binder−(minus)100° C." and more preferably not lower than the "softening point of the resin binder−(minus)90° C.". From the viewpoint of achieving both a good dispersion stability of the mixed solution and a good aggregating property of the resin particles, the pH value of the reaction system upon the addition is preferably from 2 to 10, more preferably from 2 to 8 and even more preferably from 3 to 7.

The aggregating agent may be added in the form of a solution thereof in an aqueous medium. In addition, the aggregating agent may be added at one time, or intermittently or continuously. Further, upon and after adding the monovalent salt, the obtained dispersion is preferably fully stirred.

Thus, the emulsified particles contained in the resin emulsion are aggregated to prepare aggregated particles.

From the viewpoint of reduction in particle size, the volume median particle size ($D_{50}$) of the aggregated particles is preferably from 1 to 10 μm, more preferably from 2 to 9 μm and even more preferably from 2 to 5 μm, and the coefficient of variation of particle size distribution (CV value) of the aggregated particles is preferably 30 or less, more preferably 28 or less and even more preferably 25 or less.

Meanwhile, the coefficient of variation of particle size distribution (CV value) means the value represented by the following formula.

CV Value=[Standard Deviation of Particle Size of Fine Particles (μm)/Volume Median Particle Size (μm)]×100.

In the present invention, after aggregating the emulsified particles, a surfactant is preferably added to the dispersion containing the aggregated particles. More preferably, at least one compound selected from the group consisting of alkylethersulfates, alkylsulfates and straight-chain alkylbenzenesulfonates is added to the dispersion.

The alkylethersulfates are preferably compounds represented by the following formula (1):

$$R^1—O—(CH_2CH_2O)_pSO_3M^1 \quad (1).$$

In the formula (1), $R^1$ represents an alkyl group. From the viewpoints of a good adsorption into the aggregated particles and a large residual amount in the toner, the alkyl group preferably has 6 to 20 carbon atoms and more preferably 8 to 15 carbon atoms. The suffix p represents an average molar number of addition and is a number of from 0 to 15. From the viewpoint of a well-controlled particle size of the aggregated particles, p is preferably from 1 to 10 and more preferably from 1 to 5. $M^1$ represents a monovalent cation. From the viewpoint of a well-controlled particle size of the aggregated particles, $M^1$ is preferably sodium, potassium or ammonium, and more preferably sodium or ammonium.

The straight-chain alkylbenzenesulfonates are not particularly limited. From the viewpoints of a good adsorption into the aggregated particles and a large residual amount in the toner, the straight-chain alkylbenzenesulfonates are preferably those compounds represented by the following formula (2):

$$R^2\text{-Ph-}SO_3M^2 \quad (2).$$

In the formula (2), $R^2$ represents a straight-chain alkyl group and may be the same as those which have a straight chain among the alkyl groups exemplified as $R^1$ in the formula (1). Ph is a phenyl group, and $M^2$ is a monovalent cation. As the suitable straight-chain alkylbenzenesulfonates, there may be used sodium sulfate salts thereof.

The above surfactant is added in an amount of preferably from 0.1 to 15 parts by weight, more preferably from 0.1 to 10 parts by weight and even more preferably from 0.1 to 8 parts by weight on the basis of 100 parts by weight of the resin constituting the aggregated particles from the viewpoints of a good aggregation stopping property and a large residual amount in the toner.

In the present invention, from the viewpoints of preventing run-off of the releasing agent or maintaining charge amounts of the respective colors in a color toner at the same level, etc., when aggregating the emulsified particles contained in the emulsion obtained in the step (A) (hereinafter occasionally referred to as the "emulsified particles of the present invention"), additional emulsified fine particles may be added thereto at one time or intermittently in plural divided parts. On the contrary, the emulsified particles of the present invention may be added to the additional emulsified fine particles at one time or or intermittently in plural divided parts to aggregate these emulsified particles.

The additional emulsified fine particles which may be added to the emulsified particles of the present invention are not particularly limited, and may be produced, for example, by the same method as used for producing the emulsified particles of the present invention.

In the present invention, the additional emulsified fine particles may be the same as or different from the emulsified particles of the present invention. However, from the viewpoints of a good low-temperature fusing ability and a good storage property of the resulting toner, the additional emulsified fine particles which are different from the emulsified particles of the present invention are preferably subsequently added to the emulsified particles of the present invention at one time or intermittently in plural divided parts.

In the above step, the additional emulsified fine particles may be mixed with the aggregated particles obtained by adding the aggregating agent to the resin emulsion of the present invention as described previously.

In the present invention, the time of addition of the additional emulsified fine particles is not particularly limited, and is preferably a period of from completion of addition of the aggregating agent to initiation of the unifying step from the viewpoint of a high productivity.

In the above step, the resin emulsion of the present invention may also be mixed with the aggregated particles obtained by adding the aggregating agent to the above additional emulsified fine particles.

The mixing ratio of the emulsified particles of the present invention to the additional emulsified fine particles (emulsified particles of the present invention/additional emulsified fine particles) is preferably from 0.1 to 2.0, more preferably from 0.2 to 1.5 and even more preferably from 0.3 to 1.0 in terms of a weight ratio therebetween from the viewpoint of achieving both of a good fusing ability and a good heat-resistant storage property of the resulting toner.

The thus obtained aggregated particles are subjected to the step (C) of coalescing the aggregated particle (coalescing step).

[Step (C)]

The step (C) is a step of coalescing the aggregated particles obtained in the step (B).

In the present invention, the aggregated particles obtained in the above aggregating step are heated to form coalesced particles thereof. The temperature of the reaction system in the coalescing step is desirably the same as or higher than that in the aggregating step. The temperature used in the coalescing step is preferably not lower than the glass transition point of the resin binder and not higher than the "softening point of the resin binder+(plus)20° C."; more preferably not lower than the "grass transition point of the resin binder+(plus)5° C." and not higher than the "softening point of the resin binder+(plus)15° C."; and even more preferably not lower than the "grass transition point of the resin binder+(plus)10° C." and not higher than the "softening point of the resin binder+(plus)10° C." from the viewpoints of controlling a particle size, a particle size distribution and a shape of the toner as desired, and attaining a good fusibility of the particles. In addition, the stirring rate used in the coalescing step is preferably a rate at which the aggregated particles are not precipitated.

In the present invention, the coalescing step may also be carried out simultaneously with the aggregating step, for example, by continuously raising the temperature, or by heating the reaction system up to such a temperature capable of carrying out both of the aggregating and unifying steps and then continuously stirring the reaction system at that temperature.

The volume median particle size ($D_{50}$) of the coalesced particles is preferably from 1 to 10 μm, more preferably from 2 to 8 μm and even more preferably from 3 to 8 μm from the viewpoint of a high image quality.

The thus obtained coalesced particles may be subjected to a liquid-solid separation step such as filtration, a washing step, a drying step, etc., thereby obtaining toner particles. In the washing step, the coalesced particles are preferably washed with an acid to remove metal ions from the surface of the respective toner particles for the purpose of ensuring a sufficient charging property and a good reliability of the resultant toner. Further, the nonionic surfactant added is also preferably completely removed from the coalesced particles by washing. In addition, the nonionic surfactant is preferably washed out with an aqueous solution at a temperature not higher than a cloud point of the nonionic surfactant. Meanwhile, the washing procedure is preferably repeated a plurality of times.

In addition, in the drying step, any optional methods such as vibration-type fluidization drying method, spray-drying method, freeze-drying method and flash jet method may be employed. The water content in the toner particles obtained after drying is preferably adjusted to 1.5% by weight or less and more preferably 1.0% by weight or less from the viewpoint of a good charging property of the resulting toner.

The process for producing a toner for electrophotography according to the present invention which includes the step (A), the step (B) and the step (C), further includes the following steps which are to be conducted after the step (A):

(a) a step of adding a compound having at least one functional group selected from the group consisting of an oxazoline group and a glycidyl group; and (b) a step of forming a chemical bond between the compound having the at least one functional group and the resin binder containing the polyester.

[Step (a)]

In the step (a), the functional group-containing compound of the present invention is added to the reaction system.

Functional Group-Containing Compound of the Present Invention

As the functional group-containing compound of the present invention, there may be used those compounds containing a plurality of functional groups capable of reacting with a carboxyl group (hereinafter occasionally referred to as the "functional group of the present invention") in a molecule thereof. The functional group of the present invention is preferably an oxazoline group and/or a glycidyl group from the viewpoints of a sufficient reactivity in the aqueous medium and a good charging property of the resulting toner owing to the presence of oxygen atom in the functional group.

The functional group-containing compound of the present invention is preferably a polymer compound containing the above functional group of the present invention from the viewpoints of a good fusing ability of the resulting toner and an enhanced reactivity with a carboxyl group of the resin binder. The polymer compound containing the functional group of the present invention may be obtained, for example, by polymerizing a polymerizable monomer containing the functional group of the present invention or by copolymerizing the polymerizable monomer containing the functional group of the present invention with an additional polymerizable monomer copolymerizable therewith, if required. The additional polymerizable monomer which can be copolymerized with the former polymerizable monomer may be in the form of either a polymerizable monomer containing the functional group of the present invention or a polymerizable monomer containing no functional group of the present invention.

Among these polymerizable monomers containing the functional group of the present invention, the oxazoline group-containing polymerizable monomer is not particularly limited. Examples of the oxazoline group-containing polymerizable monomer include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-5-methyl-2-oxazoline and 2-isopropenyl-5-ethyl-2-oxazoline. These oxazoline group-containing polymerizable monomers may be used alone or in combination of any two or more thereof. Among these oxazoline group-containing polymerizable monomers, 2-isopropenyl-2-oxazoline is preferred from the viewpoint of a good industrial availability.

The glycidyl group-containing polymerizable monomer is not particularly limited. Examples of the glycidyl group-containing polymerizable monomer include glycidyl methacrylate, glycidyl acrylate, allyl glycidyl ether, glycidyl allyl sulfonate, glycidyl vinyl sulfonate and glycidyl p-vinylbenzoate. Among these glycidyl group-containing polymerizable monomers, glycidyl methacrylate is preferred from the viewpoints of a good availability of the monomer and a good reactivity upon polymerization. These glycidyl group-containing polymerizable monomers may be used alone or in combination of any two or more thereof.

Among the additional polymerizable monomers which are copolymerizable with the polymerizable monomer containing the functional group of the present invention, those polymerizable monomers containing no functional group of the present invention are not particularly limited. Examples of the additional polymerizable monomers containing no functional group of the present invention include (meth)acrylic acid esters such as methyl (meth)acrylate, ethyl (meth)acrylate, n-butyl (meth)acrylate, isobutyl (meth)acrylate, t-butyl (meth)acrylate, cyclohexyl (meth)acrylate, 2-ethylhexyl (meth)acrylate, methoxy polyethylene glycol (meth)acrylate, lauryl (meth)acrylate, stearyl (meth)acrylate, 2-hydroxyethyl (meth)acrylate, 2-hydroxypropyl (meth)acrylate, a monoester of (meth)acrylic acid and polyethylene glycol, 2-aminoethyl (meth)acrylate and salts thereof, caprolactone-modified (meth)acrylic acids, (meth)acrylic acid-2,2,6,6-tetramethyl piperidine and (meth)acrylic acid-1,2,2,6,6-pentamethyl piperidine; (meth)acrylic acid salts such as sodium (meth)acrylate, potassium (meth)acrylate and ammonium (meth)acrylate; unsaturated nitriles such as acrylonitrile and methacrylonitrile; unsaturated amides such as (meth)acrylamide, N-methylol (meth)acrylamide and N-(2-hydroxyethyl) (meth)acrylamide; vinyl esters such as vinyl acetate and vinyl propionate; vinyl ethers such as methyl vinyl ether and ethyl vinyl ether; α-olefins such as ethylene and propylene; halogen-containing α,β-unsaturated aliphatic hydrocarbons such as vinyl chloride, vinylidene chloride and vinyl fluoride; and α,β-unsaturated aromatic hydrocarbons such as styrene, divinyl benzene, α-methyl styrene and sodium styrenesulfonate.

The content of the functional group of the present invention in the functional group-containing polymer compound of the present invention is preferably from 0.0001 to 0.01 mol/g and more preferably from 0.0005 to 0.01 mol/g from the viewpoint of increasing crosslinking percentage.

Examples of ordinary commercial products of the oxazoline group-containing polymer compound usable in the present invention include EPOCROSS WS series (water-soluble type) and K series (emulsion type) available from Nippon Shokubai Co., Ltd. The glycidyl group-containing polymer compound may be produced, for example, by the below-mentioned method.

The weight-average molecular weight of the functional group-containing polymer compound of the present invention is not particularly limited, and is preferably from 500 to 2,000,000 and more preferably from 1,000 to 1,000,000 from the viewpoints of increasing crosslinking percentage and easiness in handling. The functional group-containing polymer compound of the present invention which has a weight-average molecular weight of 500 or more is capable of undergoing a sufficient crosslinking reaction with the resin particles, whereas the functional group-containing polymer compound of the present invention which has a weight-average molecular weight of 2,000,000 or less has an adequate polymer viscosity value and can be readily handled.

Addition of Functional Group-Containing Compound of the Present Invention

The functional group-containing compound of the present invention may be added, for example, either i) after the step (A) and before the step (B), ii) during the step (B), iii) after the step (B) and before the step (C), or iv) during or after the step (C) from the viewpoints of a good heat-resistant storage property of the toner and a capability of broadening a fusing temperature range thereof. These addition manners may also be appropriately used in combination of any two or more thereof.

In the addition manners i) and ii), the functional group-containing compound of the present invention and the resin particles may be mixed with each other in water. In this case, the bonding reaction gradually proceeds in the step (B) and is terminated in the step (C). In the addition manner iii), the aggregated particles are more frequently crosslinked on an outside thereof than on an inside thereof, thereby forming particles having a soft inside portion and a hard outside portion. Meanwhile, after the aggregation in the step (B), the functional group-containing compound of the present invention and then resin fine particles may be respectively added to the resulting aggregated particles to obtain capsulated particles. In this case, after obtaining the capsulated particles, the functional group-containing compound of the present invention may be further added thereto. In the addition manner iv), the aggregated particles also tend to be more frequently crosslinked on an outside thereof, thereby enabling formation of particles having a soft inside portion and a hard outside portion.

In the present invention, from the viewpoint of achieving both of a good heat-resistant storage property of the toner and a capability of broadening a fusing temperature range thereof, the functional group-containing compound of the present invention is preferably added in the manners iii) or iv), i.e., after the step (B).

When adding the functional group-containing compound of the present invention, the size of the resin particles such as the aggregated particles is not particularly limited, and the volume median particle size ($D_{50}$) thereof is usually from 0.02 to 10 μm, preferably from 1 to 10 μm and more preferably from 3 to 9 μm.

The amount of the functional group-containing compound of the present invention added may be appropriately determined according to a content of the reactive function group in the compound used, a weight-average molecular weight of the compound, an acid value of the resin binder, etc. From the viewpoint of broadening a fusing temperature range of the toner, a ratio of the number of moles of the functional group contained in the functional group-containing compound of the present invention to the number of moles of a carboxyl group contained in the resin binder containing the polyester (number of moles of the functional group contained in the functional group-containing compound of the present invention/number of moles of a carboxyl group contained in the resin binder containing the polyester) is preferably 0.01 or more, more preferably 0.02 or more and even more preferably 0.05 or more, and is preferably 0.8 or less, more preferably 0.7 or less and even more preferably 0.6 or less. Therefore, the ratio of the number of moles of the functional group contained in the functional group-containing compound of the present invention to the number of moles of a carboxyl group contained in the resin binder containing the polyester is preferably from 0.01 to 0.8, more preferably from 0.02 to 0.7 and even more preferably from 0.05 to 0.6. Meanwhile, the "number of moles of a carboxyl group contained in the resin binder" as used herein means the value calculated from an acid value of the resin binder as measured under the conditions using a mixed solvent containing acetone and toluene at a volume ratio of 1:1 as a measuring solvent according to JIS K0070.

The amount of the functional group-containing compound of the present invention added is preferably 0.01 part by weight or more, more preferably 0.1 part by weight or more, even more preferably 0.5 part by weight or more and further even more preferably 1 part by weight or more, and is preferably 20 parts by weight or less, more preferably 10 parts by weight or less and even more preferably 8 parts by weight or less, on the basis of 100 parts by weight of the resin binder.

Meanwhile, the temperature of the dispersion upon addition of the above functional group-containing compound of the present invention may be lower than the temperature at which the chemically bonding reaction between the below-mentioned resin binder and the functional group-containing compound of the present invention is carried out. However, the temperature of the dispersion is preferably such a temperature at which the chemically bonding reaction is promoted.

[Step (b)]

In the step (b), the functional group-containing compound of the present invention and the resin binder containing the polyester are chemically bonded to each other.

The temperature of the chemically bonding reaction is preferably from 50 to 90° C., more preferably from 50 to 85° C. and even more preferably from 60 to 80° C. from the viewpoint of conducting the chemically bonding reaction in an efficient manner. In the present invention, it is not necessarily required that the temperatures in all of the toner production steps after adding the functional group-containing compound of the present invention lie within the above-specified range, and at least a part of the steps may be carried out within the above-specified temperature range as long as the chemically bonding reaction can proceed suitably. From the above viewpoint, in the present invention, the steps after adding the functional group-containing compound of the present invention may be continuously or intermittently maintained in the above-specified temperature range for 0.5 to 5 h and preferably for 1 to 3 h.

[Step (D)]

The thus obtained toner particles may be directly used as a toner for electrophotography, or an external additive such as a fluidizing agent may be added to treat the surface of the toner particles therewith to obtain the toner for electrophotography. As the external additive, there may be used known fine particles. Examples of the fine particles as the external additive include inorganic fine particles such as fine silica particles whose surface is subjected to a hydrophobic treatment, fine titanium oxide particles, fine alumina particles, fine cerium oxide particles and carbon blacks; and fine polymer particles such as fine particles made of polycarbonates, polymethyl methacrylate, silicone resins, etc. The external additive preferably has a number-average particle size of from 4 to 500 nm, more preferably from 4 to 200 nm and even more preferably from 8 to 30 nm. The number-average particle size of the external additive may be measured by using a scanning electron microscope or a transmission electron microscope.

The amount of the external additive formulated is preferably from 1 to 5 parts by weight and more preferably from 1.5 to 3.5 parts by weight on the basis of 100 parts by weight of the toner before being treated with the external additive.

From the viewpoints of less fogging on the obtained images, a good charging stability and an excellent heat-resistant storage property of the resulting toner, the process for producing a toner for electrophotography according to the present invention preferably further includes the following step which should be carried out after the above steps (A) to (C), i.e., (D) a step of subjecting the obtained toner particles to external addition treatment with an external additive containing magnesium oxide having a positive charging property and a number-average particle size of from 10 to 200 nm and silica or titanium oxide having a number-average particle size of from 6 to 30 nm.

The toner for electrophotography produced by the process of the present invention contains the resin binder containing polyester bonded to the functional group-containing compound of the present invention. The toner which contains the resin binder containing the polyester bonded to the functional group-containing compound of the present invention and is treated with the external additive such as silica can exhibit a high heat-resistant storage property owing to a crosslinking effect of these functional groups and a coating effect of the external additive. However, since a nitrogen element contained in these functional groups exhibits a positive charging property whereas a carboxyl group of the polyester contained in the resin binder exhibits a negative charging property, there tends to occur such a problem that the negative charging property of the toner is reduced owing to mutual cancellation of these charges.

In the present invention, specific magnesium oxide is used as the external additive, so that the resulting toner is improved in charging property thereof. More specifically, when using magnesium oxide having a positive charging property as the external additive, the magnesium oxide is moved on the surface of the toner in a roller-like manner upon frictional electrification in a developing step, i.e., upon frictional contact with a charging member such as a carrier and a charging blade to thereby cause friction between the magnesium oxide and the toner particles having a negative charging property. As a result, it is considered that the toner is enhanced in amount of negative charge thereon which is reverse to a charging polarity (positive charge) of the magnesium oxide. Such an effect cannot be obtained by use of the other positive charging inorganic fine particles.

(Magnesium Oxide)

Magnesium oxide used in the present invention has a positive charging property. From the viewpoint of a good charging property, the surface of magnesium oxide is preferably treated with a hydrophobic treatment agent.

From viewpoint of a good charging property of the resulting toner, at least one hydrophobic treatment agent is preferably selected from aminosilane-based hydrophobic treatment agents. In addition, from the viewpoint of retention of a good fluidity, the aminosilane-based hydrophobic treatment agent is preferably used in combination with a silicone oil-based hydrophobic treatment agent. Specific examples of the aminosilane-based hydrophobic treatment agent used in the present invention include aminosilane-based coupling agents such as γ-aminopropyl triethoxysilane, N-(β-aminoethyl)-γ-aminopropyl trimethoxysilane, γ-(2-aminoethyl)-γ-aminopropylmethoxy dimethoxysilane and γ-anilinopropyl trimethoxysilane. Specific examples of the silicone oil-based hydrophobic treatment agent include polydimethyl siloxane, amino-modified polydimethyl siloxane, alkyl-modified polydimethyl siloxane and fluorine-modified polydimethyl siloxane.

When using the aminosilane-based hydrophobic treatment agent in combination with the silicone oil-based hydrophobic treatment agent, the ratio between both the hydrophobic treatment agents (aminosilane-based hydrophobic treatment agent: silicone oil-based hydrophobic treatment agent) is preferably from 90:10 to 40:60 and more preferably from 80:20 to 40:60 in terms of a weight ratio therebetween from the viewpoint of a good charging property of the resulting toner.

In the present invention, from the viewpoint of ensuring a frictional contact surface of magnesium oxide with the toner, the number-average particle size of magnesium oxide is preferably from 10 to 200 nm, more preferably from 20 to 200 nm, even more preferably from 20 to 100 nm and further even more preferably from 30 to 80 nm.

Magnesium oxide preferably has a specific surface area of from 10 to 200 $m^2/g$, more preferably from 15 to 100 $m^2/g$ and even more preferably from 20 to 60 $m^2/g$ as measured by BET method from the viewpoints of a good charging property of the toner and prevention of fogging with the toner on a photosensitive member (such a phenomenon that non-image portions are developed with the toner; hereinafter referred to merely as "developability").

The content of magnesium oxide in the toner is preferably from 0.5 to 3.0% by weight, more preferably from 1.0 to 2.5% by weight and even more preferably from 1.0 to 2.2% by weight on the basis of the weight of the toner particles from the viewpoints of a good charging property and a good developability of the toner.

(Silica or Titanium Oxide)

The number-average particle size of silica or titanium oxide contained as the external additive is from 6 to 30 nm, preferably from 8 to 25 nm, more preferably from 10 to 20 nm and even more preferably from 12 to 18 nm from the viewpoints of a good storage property and a good fluidity of the toner. In addition, from the viewpoint of a good charging property of the toner, the number-average particle size of silica or titanium oxide is smaller than that of magnesium oxide, and the difference between the number-average particle sizes of the silica or titanium oxide and the magnesium oxide is preferably 5 nm or more, more preferably 10 nm or more and even more preferably 20 nm or more.

Meanwhile, the silica or titanium oxide exhibits substantially no effect of frictional electrification by contact between the toner particles and the inorganic fine particles unlike the magnesium oxide. The reason therefor is considered to be that the silica or titanium oxide is fixed on the surface of the toner particles owing to a small number-average particle size thereof. Therefore, the charging polarity of the silica or titanium oxide is not particularly limited.

The specific surface area of the silica or titanium oxide as measured by BET method is preferably from 80 to 400 $m^2/g$, more preferably from 100 to 300 $m^2/g$, even more preferably from 110 to 200 $m^2/g$ and further even more preferably from 120 to 200 $m^2/g$ from the viewpoints of a good charging property, a good heat-resistant storage property and a good fluidity of the toner.

In the present invention, among silica and titanium oxide, from the viewpoint of a good fluidity of the toner, preferred is silica. The silica used herein may be produced by conventionally known methods. From the viewpoint of attaining a good dispersibility over the surface of the respective toner particles, the silica is preferably produced by a dry method or a high-temperature hydrolyzing method. Further, from the viewpoint of a good fluidity of the toner, the silica is more preferably subjected to surface treatment with the hydrophobic treatment agent.

Examples of suitable combination of the hydrophobic treatment agent and the silica or titanium oxide (expressed below by "hydrophobic treatment agent/silica or titanium oxide") which may be used in negative charging inorganic oxides include hexamethyl disilazane (HMDS)/silica, dimethyl dichlorosilane (DMDS)/silica, silicone oil/silica, a mixture of HMDS and silicone oil/silica, isobutyl trimethoxysilane/titanium oxide, silicone oil/titanium oxide, and octyl silane/titanium oxide. Among these combinations, preferred are HMDS/silica, DMDS/silica, silicone oil/silica, a mixture of HMDS and silicone oil/silica, and isobutyl trimethoxysilane/titanium oxide; more preferred are HMDS/silica, DMDS/silica, silicone oil/silica, and a mixture of HMDS and silicone oil/silica; even more preferred are a mixture of HMDS and silicone oil/silica and silicone oil/silica; and further even more preferred is silicone oil/silica.

As the above hydrophobilized silica, there may be used known silica products. Examples of suitable commercially available products of HMDS/silica include H3004, H2000, HDK H30™, HDK H20TM, HDK H13TM and HDK H05TM all available from Wacker Chemie Corp.; TS530 available from Cabot Corp.; and RX300, RX200, RX50 and NAX-50 all available from Nippon Aerosil Co., Ltd. Examples of suitable commercially available products of DMDS/silica include R976, R974 and R972 all available from Nippon Aerosil Co., Ltd.

Examples of suitable commercially available products of silicone oil/silica include HDK H30TD, HDK H20TD, HDK H13TD and HDK H05TD all available from Wacker Chemie Corp.; TS720 available from Cabot Corp.; and RY-50 and NY-50 both available from Nippon Aerosil Co., Ltd. Examples of suitable commercially available products of a mixture of HMDS and silicone oil/silica include HDK H30TX, HDK H20TX, HDK H13TX and HDK H05TX all available from Wacker Chemie Corp. Examples of suitable commercially available products of isobutyl trimethoxysilane/titanium oxide include JMT-1501B available from Tayca Co., Ltd.

The amount of the silica or titanium oxide formulated in the toner is preferably from 0.5 to 2.5% by weight, more preferably from 1.0 to 2.0% by weight and even more preferably from 1.5 to 2.0% by weight on the basis of the weight of the toner particles from the viewpoints of a good heat-resistant storage property and a good developability of the toner.

The proportion of a content of the magnesium oxide to a content of the silica or titanium oxide in the toner particles (content of magnesium oxide/content of silica or titanium oxide) is preferably from 0.4 to 1.5, more preferably from 0.6 to 1.4, even more preferably from 0.7 to 1.3 and further even more preferably from 0.7 to 1.2 in terms of a weight ratio therebetween from the viewpoints of a good charging property and a good developability of the resulting toner.

(Organic Fine Particles)

The external additive preferably further contains organic fine particles from the viewpoints of a good charging property and a good developability of the resulting toner. Specific examples of materials of the organic fine particles include styrene and derivatives thereof; ethylenically monocarboxylic acids and esters thereof such as acrylic acid, methyl acrylate, ethyl acrylate, butyl acrylate, 2-ethylhexyl acrylate, dodecyl acrylate, phenyl acrylate, methacrylic acid, methyl methacrylate and butyl methacrylate; N,N-dialkylaminoalkyl (meth)acrylates such as N,N-dimethylaminomethyl (meth) acrylate, N,N-dimethylaminoethyl (meth)acrylate and N,N-diethylaminoethyl (meth)acrylate; N,N-dialkylaminoalkyl (meth)acrylamides such as N,N-dimethylaminoethyl (meth) acrylamide and N,N-dimethylaminopropyl (meth)acrylamide; fluorine-based monomers such as trifluoroacrylate and perfluoroacrylate; and silicone-based monomers. Among these organic fine particles, from the viewpoint of imparting a good charging property to the toner, preferred are fine particles of ethylenically monocarboxylic acids and esters thereof; more preferred are fine particles of (meth)acrylic acid and alkyl ($C_1$ to $C_4$) esters thereof; and even more preferred are fine particles of copolymers of methyl methacrylate and butyl acrylate. These organic fine particles may be used alone or in the form of a mixture of any two or more thereof.

As the organic fine particles, there may also be used fine particles of compounds having a triazine skeleton or aldehydes. Examples of the compounds having a triazine skeleton include melamine and benzoguanamine. Among these compounds, from the viewpoint of imparting a good charging property to the toner, preferred is melamine. Examples of the aldehydes include formaldehyde, acetaldehyde, propionaldehyde and glyoxal. Among these aldehydes, from the viewpoints of a good charging property and a good developability of the toner, preferred is formaldehyde.

In addition, from the viewpoint of a good developability of the toner, the number-average particle size of the organic fine particles is preferably from 100 to 600 nm, more preferably from 200 to 500 nm and even more preferably from 200 to 400 nm.

The specific surface area of the organic fine particles as measured by BET method is preferably from 2 to 50 $m^2/g$ and more preferably from 5 to 40 $m^2/g$ from the viewpoints of a good charging property and a good fluidity of the toner.

The content of the organic fine particles in the toner is preferably from 0.05 to 2.0% by weight, more preferably from 0.1 to 1.5% by weight and even more preferably from 0.2 to 1.0% by weight on the basis of the weight of the toner particles from the viewpoint of a good developability of the resulting toner.

The proportion of a content of the magnesium oxide to a content of the organic fine particles in the toner particles (content of magnesium oxide/content of organic fine particles) is preferably from 0.3 to 60, more preferably from 1 to 30 and even more preferably from 1 to 10 in terms of a weight ratio therebetween from the viewpoint of a good developability of the resulting toner.

In the step (D), the toner particles obtained in the above step (C) are treated with an external additive containing the positive charging magnesium oxide having a number-average particle size of from 10 to 200 nm and the silica or titanium oxide having a number-average particle size of from 6 to 30 nm.

The method of treating the surface of the toner particles with the external additive which involves the method of adding the external additive to the toner particles and mixing them together, is not particularly limited. The toner particles and the external additive may be mixed with each other using a known stirrer. Examples of the stirrer used in the present invention include a Henschel mixer available from Mitsui Miike Machinery, a Super mixer available from Kawata Co., Ltd., and a Mechano-Fusion System available from Hosokawa Micron Corporation. Among these stirrers, from the viewpoint of a high agitation power, preferred is a Henschel mixer. When using these stirrers, a peripheral speed of the stirrer and a stirring time are suitably controlled in order to attach a sufficient amount of the external additive onto the toner. The peripheral speed of the stirrer may vary depending upon a diameter of an agitation blade used therein, and is preferably in the range of from 20 to 50 m/s. When using the Henschel mixer having a capacity of 5 L, the peripheral speed thereof is more preferably from 25 to 45 m/s and even more preferably from 30 to 40 m/s. The stirring time for the stirrer is preferably in the range of from 60 to 600 s. When using the Henschel mixer having a capacity of 5 L, the stirring time therefor is more preferably from 120 to 480 s and even more preferably from 120 to 300 s.

In the present invention, after completing the above surface treatment step, an untreated toner in the form of a simple mixture with the external additive is preferably removed by subjecting the obtained toner particles to a screening step to thereby obtain the toner of the present invention. The screening step is preferably conducted using a fine mesh sieve. The mesh size of the sieve used is preferably 300 mesh or more having a sieve opening of 50 μm or less. Examples of the sieve device used in the screening step include a Sato-type vibration sieve available from Koei Sangyo Co., Ltd., a gyro-shifter available from Tokuju Kosakusho Co., Ltd., and an ultrasonic sieve available from Russell Finex Corp. Among these sieve devices, preferred is an ultrasonic sieve because of less production of foreign matters and less occurrence of deterioration in quality.

<Toner for Electrophotography>

The toner for electrophotography according to the present invention is obtained by the above production process.

The toner for electrophotography according to the present invention has a chemical bond formed by the reaction between the resin binder and the functional group-containing compound of the present invention. The chemical bond may be, for example, a group formed upon the reaction by bonding a carboxyl group, etc., of the resin binder containing the polyester to a ring-opened functional group of the functional group-containing compound of the present invention which is capable of reacting with the carboxyl group.

In the present invention, the chemical bond may be contained in the finally produced toner. For example, in the method for producing the toner by aggregating the resin particles obtained by emulsifying the resin binder in an aqueous medium, from the viewpoints of formation of spherical toner particles and an improved heat-resistant storage property of the toner, the chemical bond in the toner is formed by adding the functional group-containing compound of the present invention preferably after the aggregating step and more preferably after the coalescing step. In addition, the chemical bond is preferably present at least on the surface of the aggregated or coalesced particles.

Meanwhile, the presence of the chemical bond in the toner means formation of a crosslinked structure therein. Therefore, for example, the presence of the chemical bond may be determined by presence of insoluble components which are obtained when the resulting toner is subjected to Soxhlet extraction using tetrahydrofuran (THF). In order to attain the aimed effects of the present invention, the insoluble components are preferably present in an amount of from 5 to 50% by weight and more preferably from 10 to 30% by weight on the basis of the weight of the toner particles. Meanwhile, the amount of the insoluble components may be measured, for example, by the following method. That is, 1 g of the toner is weighed and sampled in a cylindrical filter paper, and then subjected to Soxhlet extraction using 200 g of THF at 85° C. for 24 h, followed by drying the obtained insoluble components on the cylindrical filter paper at 50° C. under a reduced pressure of 70 mmHg until no further change in weight of the insoluble components occurs. The weight percent of the insoluble components is calculated from the thus measured weight.

Also, the chemical bond formed by the reaction between the resin binder containing the polyester and the functional group-containing compound of the present invention can be identified by analysis of an amide group in the toner. More specifically, the presence of the amide group may be confirmed by presence of absorption peak due to C═O stretch or C═N stretching vibration near 1650 $cm^{-1}$ by an infrared spectroscopic analysis (IR). Meanwhile, in order to improve a detection sensitivity, the insoluble components obtained from the Soxhlet extraction using THF are preferably analyzed after dried by FT-IR ATR (attenuation total reflection) method.

The toner for electrophotography according to the present invention contains the resin binder containing the polyester which is bonded to the functional group-containing compound of the present invention. The toner of the present invention may contain not only the resin binder containing the polyester which is bonded to the functional group-containing compound of the present invention, but also a resin binder containing the polyester which is not bonded to the functional group-containing compound of the present invention. It is considered that the contents of these resin binders containing the polyester which are bonded or not bonded to the functional group-containing compound of the present invention vary depending upon the proportion of a carboxyl group, etc., contained in the resin binders containing the polyester to the functional group contained in the functional group-containing compound.

The toner for electrophotography according to the present invention preferably has a softening point of from 105 to 200° C., more preferably from 105 to 180° C. and even more preferably from 105 to 160° C. from the viewpoint of broadening a fusing temperature range of the resulting toner. In addition, the toner preferably has a glass transition point of from 30 to 80° C. and more preferably from 40 to 70° C. from the viewpoints of a good low-temperature fusing ability and a good heat-resistant storage property of the resulting toner. Meanwhile, the softening point and the glass transition point of the toner may be measured according to the same methods as used above for measuring those of the resins.

The volume median particle size ($D_{50}$) of the toner particles is preferably 1 μm or more, more preferably 2 μm or more and even more preferably 3 μm or more, and is preferably 10 μm or less, more preferably 9 μm or less, even more preferably 8 μm or less, further even more preferably 7 μm or less and further even more preferably 6 μm or less from the viewpoint of a high image quality. Namely, the volume median particle size ($D_{50}$) of the toner particles is preferably from 2 to 10 μm, more preferably from 2 to 8 μm, even more preferably from 2 to 7 μm and further even more preferably from 3 to 6 μm.

In addition, the circularity of the toner is preferably from 0.93 to 1.00, more preferably from 0.94 to 0.99 and even more preferably from 0.95 to 0.99 from the viewpoint of improving a transfer property, broadening a fusing temperature range of the toner. The circularity of the toner may be measured by using a flow type particle image analyzer, more specifically by using an analyzer "FPIA-3000" available from Sysmex Corp. The circularity of the particles as used in the present invention means the value calculated from a ratio of a peripheral length of a circle having the same area as a projected area of a particle to a peripheral length of a projected image of the particle. As the shape of the particles is closer to a sphere, the circularity of the particles becomes closer to 1.

Also, the CV values of the above aggregated particles, coalesced particles and toner particles all are preferably 45 or less, more preferably 35 or less and even more preferably 30 or less.

The particle size and the particle size distribution of the toner particles may be measured by the below-mentioned methods.

The toner for electrophotography obtained according to the present invention can be used as one-component system developer, or can be mixed with a carrier to form a two-component system developer.

EXAMPLES

In the following Examples, etc., various properties were measured and evaluated by the following methods.

[Acid Value of Resins]

Determined according to JIS K0070. However, as the solvent for the measurement, there was used a mixed solvent containing acetone and toluene at a volume ratio of 1:1.

[Softening Point and Glass Transition Point of Resins and Toner]

(1) Softening Point

Using a flow tester "CFT-500D" available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

(2) Glass Transition Point

Using a differential scanning calorimeter ("DSC 210" commercially available from Seiko Instruments & Electronic, Ltd.), a sample was heated to 200° C. and then cooled from 200° C. to 0° C. at a temperature drop rate of 10° C./min, and thereafter heated again at temperature rise rate of 10° C./min to prepare an endothermic curve thereof. The glass transition point of the sample was read out from the endothermic curve and determined as the temperature at which an extension of a base line below the endothermic maximum peak temperature intersects a tangential line having a maximum inclination in a region from a raise-up portion to an apex of the peak in the curve.

[Number-Average Molecular Weight of Resins]

The number-average molecular weight was calculated from the molecular weight distribution measured by gel permeation chromatography according to the following method.

(1) Preparation of Sample Solution

The resin binder was dissolved in chloroform to prepare a solution having a concentration of 0.5 g/100 mL. The resultant solution was then filtered through a fluororesin filter ("FP-200" commercially available from Sumitomo Electric Industries, Ltd.) having a pore size of 2 μm to remove insoluble components therefrom, thereby preparing a sample solution.

(2) Measurement of Molecular Weight Distribution

Tetrahydrofuran as a dissolvent was allowed to flow through a column at a flow rate of 1 mL/min, and the column was stabilized in a thermostat at 40° C. One hundred microliters of the sample solution was injected to the column to determine a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Toso Company Ltd.; and those polystyrenes having molecular weights of $2.10\times10^3$, $7.00\times10^3$ and $5.04\times10^4$ available from GL Science Inc.) as standard samples.

Analyzer: CO-8010 (commercially available from Toso Company Ltd.)

Column: GMHLX+G3000HXL (commercially available from Toso Company Ltd.)

[Particle Size of Resin Particles and Aggregated Particles]

(1) Measuring Apparatus: Laser diffraction particle size analyzer ("LA-920" commercially available from Horiba Ltd.)

(2) Measuring Conditions: Using a cell for the measurement which was filled with distilled water, a volume median particle size ($D_{50}$) of the particles was measured at a temperature at which an absorbance thereof was within an adequate range. Meanwhile, the particle size distribution was indicated by the CV value calculated according to the following formula:

$$\text{CV Value}=(\text{Standard Deviation of Particle Size Distribution}/\text{Volume Median Particle Size } (D_{50}))\times100.$$

[Number-Average Molecular Weight of Functional Group-Containing Polymer Compound of the Present Invention]

Using the below-mentioned analyzer, a dissolvent containing 60 mM of $H_3PO_4$ and 50 mM of LiBr/DMF (guaranteed) was allowed to flow therethrough at a flow rate of 1 mL/min, and the column was stabilized in a thermostat at 40° C. One hundred microliters of a 5 mg/mL sample solution was injected to the column to determine a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Toso Company Ltd.; and those polystyrenes having molecular weights of $2.10\times10^3$, $7.00\times10^3$ and $5.04\times10^4$ available from GL Science Inc.) as standard samples.

Analyzer: CO-8010 (commercially available from Toso Company Ltd.)

Column: α-M+α-M (commercially available from Toso Company Ltd.)

[Particle Size of Toner]

Measuring Apparatus: Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Electrolyte Solution: "Isotone II" (commercially available from Beckman Coulter Inc.)

Dispersing Solution: The dispersing solution was prepared by dissolving "EMALGEN 109P" (commercially available from Kao Corporation; polyoxyethylene lauryl ether; HLB: 13.6) in the above electrolyte solution such that the concentration of "EMALGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, thereby controlling a concentration of the resultant dispersion such that the determination for 30000 particles were completed within 20 s, then, the particle sizes of 30000 particles were measured under such a concentration condition, and a volume median particle size ($D_{50}$) thereof was determined from the particle size distribution.

Meanwhile, the particle size distribution was indicated by the CV value calculated according to the following formula:

$$\text{CV Value}=(\text{Standard Deviation of Particle Size Distribution}/\text{Volume Median Particle Size } (D_{50}))\times100.$$

[Melting Point of Releasing Agent]

Using a differential scanning calorimeter ("DSC 210" commercially available from Seiko Instruments & Electronic, Ltd.), a sample was heated at a temperature rise rate of 10° C./min, to measure a melting peak value as a melting point of the sample.

[Insoluble Components of Toner]

One gram of a toner was weighed and sampled in a cylindrical filter paper, and then subjected to Soxhlet extraction using 200 g of THF at 85° C. for 24 h. Thereafter, insoluble components remaining on the cylindrical filter paper were dried at 50° C. under a reduced pressure of 70 mmHg until no further change in weight of the insoluble components was observed to measure the weight thereof. The weight percent of the insoluble components in the toner was calculated from the thus measured weight.

[Circularity of Toner]

Measuring Apparatus: Flow type Particle Image Analyzer "FPIA-3000" available from Sysmex Corp.

Measuring Conditions: One milliliter of the dispersion of the toner was sampled and diluted with distilled water to prepare a sample solution to be measured which had a concentration of 1/20 time that of the dispersion. Using a total count measurement (effective number of particles to be analyzed: 1000) as a counting method and setting a measuring mode to HPF and a magnification of an objective lens to 10 times, an average circularity of the particles contained in the sample solution was measured. The circularity of the particles is the value calculated from a ratio of a peripheral length of a circle having the same area as a projected area of the particle to a peripheral length of a projected image of the particle. As the shape of the particles is closer to a sphere, the circularity of the particles becomes closer to 1.

[Number-Average Particle Size of External Additive]

The average particle sizes of positive charging magnesium oxide, silica or titanium oxide, and organic fine particles were respectively measured by the following method.

Measuring Apparatus Field emission-type electron microscope ("S4000" available from Hitachi Limited)

Measuring Conditions: Irradiation voltage: 10 kV

Using a vacuum deposition apparatus, platinum and palladium were previously vacuum-deposited on the surface of a sample to observe primary particles of the fine particles using the above electron microscope. The magnifying power of the electron microscope upon the measurement varies depending upon particle size of the fine particles to be measured. On the basis of the particle size of the fine particles as observed and measured at a magnifying power of ×20000, the particles corresponding to those having a particle size of more than 0.6 μm were observed at a magnifying power of ×2; the particles corresponding to those having a particle size of from 0.1 to 0.6 μm were observed at a magnifying power of ×20000; the particles corresponding to those having a particle size of from 0.02 to 0.1 μm were observed at a magnifying power of ×50000; and the particles corresponding to those having a particle size of less than 0.02 μm were observed at a magnifying power of ×100000. Twenty particle images were selected to calculate a number-average particle size thereof using an image analyzing software "Scion Image".

[Charge Amount of External Additive]

The external additive and a silicone ferrite carrier (available from Kanto Denka Kogyo Co., Ltd.; number-average particle size: 90 μm) which were weighed and sampled in amounts of 0.9 g and 29.1 g, respectively, were mixed with each other using a ball mill at a rotating speed of 250 r/min to measure a charge amount thereon after the elapse of mixing time of 10 s using a q/m meter available from EPPING Corp.

Measuring Apparatus: q/m meter available from EPPING Corp.

Setting of Measuring Conditions:

Mesh Size: 400 mesh (opening: 32 μm; stainless steel screen)

Soft Blow

Blow Pressure: 1050 V

Suction Time: 90 s

Charge Amount (μC/g)=[Total quantity of electricity (μC) after 90 s]/[Amount (g) of external additive sucked]

[Measurement of Image Density of Printed Image]

Image was outputted and printed on a wood-free paper ("J Paper" available from Fuji Xerox Corp.; size: A4) using a commercially available printer ("ML5400" available from Oki Data Corporation), and placed on 30 sheets of J Paper to measure a reflection image density thereof using a colorimeter ("SpectroEye" available from Gretag-Macbeth Corp.) under the conditions of a standard light source $D_{50}$, an observation visual field of 2°, and density standard according to DIN NB and standard based on absolute white color.

[Evaluation of Fusing Ability of Toner]

Image was outputted and printed on a wood-free paper ("J Paper" available from Fuji Xerox Corp.; size: A4) using a commercially available printer ("ML5400" available from Oki Data Corporation). The image thus outputted was an unfused solid image having a length of 50 mm which was printed on the A4 paper except for its top margin of the A4 paper extending 5 mm from a top end thereof such that an amount of the toner deposited on the paper was 0.45±0.03 mg/cm$^2$. The thus obtained unfused image on the paper was fused by passing the paper through a fusing device mounted in the printer which was modified so as to variably control its fusing temperature, at a temperature-fusing speed of 34 sheets/min (in the longitudinal direction of the A4 paper). The thus fused image was evaluated for its fusing ability by the following tape peeling method.

A mending tape ("Scotch Mending Tape 810" available from 3M; width: 18 mm) was cut into a length of 50 mm and lightly attached to the top margin of the paper above an upper end of the fused image. Then, a weight of 500 g was rested on the tape and reciprocated by one stroke over the tape at a speed of 10 mm/s while press-contacting the weight thereon. Thereafter, the attached tape was peeled off from its lower end at a peel angle of 180° and a peel speed of 10 mm/s. The reflection image densities before and after attaching the tape to the fused image were measured by the above method and the fusing rate of the toner was calculated from the thus measured reflection image densities according to the following formula.

Fusing Rate=(Image density after peeling the tape/Image density before attaching the tape)×100

The fusing rate at which the image density after peeling the tape is the same value as the image density before attaching the tape is regarded as being 100. The lower fusing rate indicates a poorer fusing ability of the toner. The toner having a fusing rate of 90 or more is determined to have a good fusing ability.

The above test was carried out in the temperature range of from the fusing temperature at which cold offset occurred or the fusing rate became less than 90 to the fusing temperature at which hot offset occurred, at intervals of 5° C. Meanwhile, the "cold offset" as used herein means such a phenomenon that when the fusing temperature is low, the toner of an unfused image fails to be sufficiently fused and is attached onto a fusing roller. On the other hand, the "hot offset" as used herein means such a phenomenon that when the fusing temperature is high, the toner of an unfused image is reduced in viscoelasticity and attached onto a fusing roller. The occurrence of the "cold offset" or "hot offset" may be ascertained by observing whether or not after one rotation of the fusing roller, any toner is attached again onto the paper. In the above test, the occurrence of the "cold offset" or "hot offset" was ascertained by observing whether or not the toner was attached onto a portion of the fusing roller located 87 mm from an upper end of a solid image formed thereon. In this case, the hot offset temperature means the temperature at which the hot offset is initiated. Whereas, the minimum fusing temperature means the temperature at which no cold offset occurs, or the lowest temperature among those temperatures at which the fusing rate is 90 or more. The term "no presence of the minimum fusing temperature" means that no temperature range capable of fusing the toner exists between the temperature at which the cold offset occurs or the fusing rate is less than 90 and the temperature at which the hot offset is initiated.

[Evaluation of Heat-Resistant Storage Property of Toner]

Ten grams of a toner was charged into a 20 mL polymer bottle, and allowed to stand under environmental conditions of a temperature of 50° C. and a relative humidity of 40% RH for 48 h with the bottle being kept opened. Thereafter, the toner was measured for its aggregating degree using a powder tester available from Hosokawa Micron Corporation, to evaluate an anti-blocking property thereof according to the following ratings. The results are shown in Table 3. Meanwhile, the measurement of the aggregating degree using the powder tester was specifically conducted as follows.

On a vibrating table of the powder tester, three sieves having different mesh sizes of 250 μm, 150 μm and 75 μm were respectively set to an upper stage, an intermediate stage and a lower stage of the tester in this order, and 2 g of the toner were placed on the upper stage sieve and vibrated for 60 s to measure a weight of the toner as a reside on the respective sieves.

The aggregating degree (%) of the toner was determined from the thus measured weights of the toner according to the following formula:

$$\text{Aggregating Degree (\%)}=a+b+c$$

wherein a=[(weight of residual toner on the upper stage sieve)/2 (g)]×100; b=[(weight of residual toner on the intermediate stage sieve)/2 (g)]×100×(3/5); and c=[(weight of residual toner on the lower stage sieve)/2 (g)]×100×(1/5).

The heat-resistant storage property was evaluated from the thus determined aggregating degree as follows.

A: Aggregating degree was less than 10, and storage property was very good;

B: Aggregating degree was not less than 10 but less than 20, and storage property was good; and C: Aggregating degree was not less than 20, and storage property was poor.

[Evaluation of Developability: Method for Evaluating Fogging of Toner]

A plain color image was printed on an "Excellent White" paper (available from Oki Data Corporation; 80 g/m$^2$ paper) using a commercially available printer ("ML5400" available from Oki Data Corporation). The operation of the printer was interrupted at the time at which a half of the plain color image was transferred on the A4 paper. A transparent mending tape ("Scotch Mending Tape 810-3-18" available from 3M) was attached onto a surface of a photosensitive member before transferring the image thereto, to sample the toner causing fogging thereon.

Both a mending tape as a reference and the above mending tape on which the toner causing fogging was sampled, were attached onto a virgin "Excellent White" paper which was in turn placed on 30 sheet of the "Excellent White" paper. The mending tape as a reference was subjected to measurement of CIE L*, a* and b* values under the conditions of a standard light source D50 and an observation visual field of 2° using a colorimeter "SpectroEye" available from Gretag-Macbeth Corp., to determine a whiteness degree thereof as a whiteness standard, and then the mending tape on which the toner causing fogging was sampled was also measured for CIE L*, a* and b* values in the same manner. The color difference (ΔE) between both the mending tapes was calculated according to the following formula, and determined as fogging on the photosensitive member.

$$\Delta E=(\Delta L^{*2}+\Delta a^{*2}+\Delta b^{*2})^{1/2}$$

The smaller ΔE value indicates a less fogging and a more excellent developability.

[Charge Amount on Developing Roller]

A solid image was printed using the above printer. The operation of the printer was interrupted at the time at which a half of the solid image was transferred onto the A4 paper. Two jigs each having a size of 1 cm×2 cm were respectively fitted onto a developing roller at the positions of 3 cm from opposite ends of the developing roller to measure a charge amount on the developing roller using a Q/m meter ("210HS" available from Trek Corp.). The larger charge amount indicates a higher charging property of the toner.

Polyester Production Example 1

Production of Polyester A

In a nitrogen atmosphere, 8,320 g of polyoxypropylene (2.2)-2,2-bis(4-hydroxyphenyl)propane, 80 g of polyoxyethylene (2.0)-2,2-bis(4-hydroxyphenyl)propane, 1,592 g of terephthalic acid and 32 g of dibutyl tin oxide (as an esterification catalyst) were reacted with each other under normal pressure (101.3 kPa) at 230° C. for 5 h, and further reacted under reduced pressure (8.3 kPa). After the obtained reaction mixture was cooled to 210° C., 1,672 g of fumaric acid and 8 g of hydroquinone were added thereto to conduct a reaction therebetween for 5 h, and further the reaction was conducted under reduced pressure, thereby obtaining a polyester A. The thus obtained polyester A had a softening point of 110° C., a glass transition point of 66° C., an acid value of 24.4 mg KOH/g, and a number-average molecular weight of 3,760. One kilogram of the obtained polyester A was passed through a sieve having an opening diameter of 5.6 mm. As a result, it was confirmed that no residue on the sieve remained.

Polyester Production Example 2

Production of Polyester B

A four-necked flask equipped with a nitrogen inlet tube, a dehydration tube, a stirrer and a thermocouple was charged with 17,500 g of polyoxypropylene (2.2)-2,2-bis(4-hydroxyphenyl)propane, 16,250 g of polyoxyethylene (2.0)-2,2-bis(4-hydroxyphenyl)propane, 11,454 g of terephthalic acid, 1,608 g of dodecenyl succinic anhydride, 4,800 g of trimellitic anhydride and 15 g of dibutyl tin oxide, and the contents of the flask were reacted with each other while stirring at 220° C. in a nitrogen atmosphere until the softening point as measured according to ASTM D36-86 reached 120° C., thereby obtaining a polyester B. The thus obtained polyester B had a softening point of 121° C., a glass transition point of 65° C., an acid value of 18.5 mg KOH/g and a number-average molecular weight of 3,394. One kilogram of the obtained polyester resin B was passed through a sieve having an opening diameter of 5.6 mm. As a result, it was confirmed that no residue on the sieve remained.

Polyester Production Example 3

Production of Polyester C

A four-necked flask equipped with a nitrogen inlet tube, a dehydration tube, a stirrer and a thermocouple was charged with 34,090 g of polyoxypropylene (2.2)-2,2-bis(4-hydroxyphenyl)propane, 5,800 g of fumaric acid and 15 g of dibutyl tin oxide, and the contents of the flask were reacted with each other while stirring at 230° C. in a nitrogen atmosphere until the softening point as measured according to ASTM D36-86 reached 100° C., thereby obtaining a polyester C. The thus obtained polyester C had a softening point of 98° C., a glass transition point of 56° C., an acid value of 22.4 mg KOH/g and a number-average molecular weight of 2,930. One kilogram of the obtained polyester C was passed through a sieve having an opening diameter of 5.6 mm. As a result, it was confirmed that no residue on the sieve remained.

Polyester Production Example 4

Production of Polyester D

A four-necked flask equipped with a nitrogen inlet tube, a dehydration tube, a stirrer and a thermocouple was charged with 3,374 g of polyoxypropylene (2.2)-2,2-bis(4-hydroxyphenyl)propane, 32.5 g of polyoxyethylene (2.0)-2,2-bis(4-hydroxyphenyl)propane, 1,162 g of terephthalic acid and 24.8 g of tin 2-ethylhexanoate (as an esterification catalyst), and the contents of the flask were reacted with each other at 230° C. under normal pressure in a nitrogen atmosphere for 5 h, and further reacted under reduced pressure. After the obtained reaction mixture was cooled to 210° C., 348 g of fumaric acid and 0.49 g of tert-butyl catechol were added thereto to conduct a reaction therebetween for 5 h, and further the reaction was conducted under reduced pressure, thereby obtaining a polyester D. The thus obtained polyester D had a softening point of 107.1° C., a glass transition point of 66.9° C., an acid value of 23.3 mg KOH/g and a number-average molecular weight of 2,400. One kilogram of the obtained polyester D was passed through a sieve having an opening diameter of 5.6 mm. As a result, it was confirmed that no residue on the sieve remained.

Master Batch Production Example 1

Production of Master Batch 1

Seventy parts by weight of fine particles of the polyester C obtained in Polyester Production Example 3 and 30 parts by weight (in terms of a pigment content) of a slurry pigment of copper phthalocyanine ("ECB-301"; solid content: 46.2% by weight) available from Dainichiseika Color & Chemicals Mtg. Co., Ltd., were charged into a Henschel mixer, and mixed with each other for 5 min to obtain a wet mixture. The resulting mixture was charged into a kneader-type mixer and gradually heated. The resin was melted at a temperature of about 90 to about 110° C., and the mixture was kneaded under the condition that water was still present therein, and further continuously kneaded at a temperature of 90 to 110° C. for 20 min while evaporating water therefrom.

The resulting kneaded material was continuously kneaded at 120° C. to evaporate residual water therefrom, followed by dehydrating and drying, and further continuously kneaded at a temperature of 120 to 130° C. for 10 min. After cooling, the obtained kneaded material was further kneaded with a heating three-roll mill, cooled and coarsely crushed, thereby obtaining a high-concentration colored composition in the form of coarse particles containing 30% by weight of a blue pigment (master batch 1). The resulting composition was placed on a slide glass, and heat-melted. As a result of observing the melted composition by using a microscope, it was confirmed that the pigment particles were entirely finely dispersed in the composition, and no coarse particles were present therein. One kilogram of the obtained master batch 1 was passed through a sieve having an opening diameter of 5.6 mm.

As a result, it was confirmed that no residue on the sieve remained.

Resin Emulsion Production Example 1

Production of Resin Emulsion 1

A 10 L stainless steel flask was charged with 1,493 g of the polyester A, 980 g of the polyester B, 467.6 g of the master batch 1, 28 g of a nonionic surfactant ("EMALGEN 430" available from Kao Corp.), 186.7 g of an anionic surfactant ("NEOPELEX G-15" available from Kao Corp.; 15 wt % aqueous solution of sodium dodecylbenzenesulfonate) and 1,287 g of a potassium hydroxide aqueous solution (as a neutralizing agent; concentration: 5% by weight), and the contents of the flask were melted at 98° C. for 2 h while stirring with a paddle-shaped stirrer at a rate of 200 rpm, thereby obtaining a resin binder mixture. Successively, while stirring with a paddle-shaped stirrer at a rate of 200 rpm, 5,311 g in total of deionized water was dropped into the flask at a rate of 28 g/min to prepare a resin emulsion. Finally, the obtained resin emulsion was cooled to room temperature and passed through a wire mesh having a 200 mesh screen (opening: 105 μm) to obtain an emulsion of finely divided resin particles having a resin content of 29% by weight. The primary particles of the resin fine particles had a volume median particle size ($D_{50}$) of 0.152 μm and a coefficient of variation of particle size distribution (CV value) of 25.8. No residual components remained on the wire mesh. The thus obtained emulsion was mixed with ion-exchanged water to control a resin content therein to 23% by weight, thereby obtaining a resin emulsion 1.

Resin Emulsion Production Example 2

Production of Resin Emulsion 2

A 5 L stainless steel flask was charged with 600 g of the polyester D, 100 g of the master batch 1, 6.7 g of a nonionic surfactant ("EMALGEN 430" available from Kao Corp.), 44.7 g of an anionic surfactant ("NEOPELEX G-15" available from Kao Corp.; 15 wt % aqueous solution of sodium dodecylbenzenesulfonate) and 311 g of a potassium hydroxide aqueous solution (as a neutralizing agent; concentration: 5% by weight), and the contents of the flask were melted at 95° C. for 2 h while stirring with a paddle-shaped stirrer at a rate of 200 rpm, thereby obtaining a resin binder mixture. Successively, while stirring with a paddle-shaped stirrer at a rate of 200 rpm, 1,268 g in total of deionized water was dropped into the flask at a rate of 6 g/min to prepare a resin emulsion. Finally, the obtained resin emulsion was cooled to room temperature and passed through a wire mesh having a 200 mesh screen (opening: 105 μm) to obtain an emulsion of finely divided resin particles having a resin content of 31% by weight. The primary particles of the resin fine particles had a volume median particle size ($D_{50}$) of 0.156 μm and a coefficient of variation of particle size distribution (CV value) of 26.4. No residual components remained on the wire mesh. The thus obtained emulsion was mixed with ion-exchanged water to control a resin content therein to 23% by weight, thereby obtaining a resin emulsion 2.

Releasing Agent Dispersion Production Example 1

Production of Releasing Agent Dispersion 1

After dissolving 10.71 g of an aqueous solution of dipotassium alkenyl (mixture of hexadecenyl group and octadecenyl group) succinate ("LATEMUL ASK" available from Kao Corp.; concentration of effective ingredients: 28% by weight) in 1,200 g of deionized water in a 2 L beaker, 300 g of a carnauba wax (available from S. KATO & Company; melting point: 85° C.) were dispersed in the resultant solution. While maintaining the obtained dispersion at a temperature of 90 to 95° C., the dispersion was subjected to dispersing treatment for 60 min by using "Ultrasonic Homogenizer 600W" (available from Nippon Seiki Co., Ltd.) and then cooled to room temperature. The resulting releasing agent emulsified particles had a volume median particle size ($D_{50}$) of 0.512 μm and a coefficient of variation of particle size distribution (CV value) of 42.2. The thus obtained dispersion was mixed with ion-exchanged water to control a wax content therein to 20% by weight, thereby obtaining a releasing agent dispersion 1.

Aggregated Particle Dispersion Production Example 1

Production of Aggregated Particle Dispersion 1

A 5 L three-necked separable flask was charged with 1,200 g of the resin emulsion 1 (resin content: 23% by weight) at room temperature. Then, while stirring the resin emulsion with a paddle-shaped stirrer at a rate of 100 rpm, 78.7 g of the releasing agent dispersion 1 (wax content: 20% by weight) were added to and mixed with the resin emulsion. To the resulting dispersion were added 574 g of a 11.2 wt % ammonium sulfate aqueous solution as an aggregating agent at a rate of 9.6 g/min, and the obtained mixture was further stirred at room temperature for 20 min. Thereafter, the resulting mixed dispersion was heated from room temperature to 50° C. (at a temperature rise rate of 0.25° C./min) and then maintained at 50° C. for 2 h, thereby obtaining a dispersion containing aggregated particles having a volume median particle size of 3.59 μm and a CV value of 21.9.

Next, 120 g of the resin emulsion 1 (resin content: 23% by weight) were added at a rate of 2 g/min to the thus obtained dispersion maintained at 50° C., and then the resulting dispersion was further stirred for 20 min. This procedure was further repeated twice. Then, 120 g of the resin emulsion 1 (resin content: 23% by weight) and 120 g of a 6.4 wt % ammonium sulfate aqueous solution were simultaneously added at a rate of 2 g/min through different ports of the separable flask, and then the resulting dispersion was stirred for 20 min. This procedure was repeated one more time, thereby obtaining 2,621 g of an aggregated particle dispersion 1 containing aggregated particles having a volume median particle size of 4.96 μm and a CV value of 24.7.

Aggregated Particle Dispersion Production Example 2

Production of Aggregated Particle Dispersion 2

A 5 L three-necked separable flask was charged with 1,200 g of the resin emulsion 1 (resin content: 23% by weight) at room temperature. Then, while stirring the resin emulsion with a paddle-shaped stirrer at a rate of 100 rpm, 78.7 g of the releasing agent dispersion 1 (wax content: 20% by weight) were added to and mixed with the resin emulsion. To the resulting dispersion were added 574 g of a 11.2 wt % ammonium sulfate aqueous solution as an aggregating agent at a rate of 15 g/min, and the obtained mixture was further stirred at room temperature for 20 min. Thereafter, the resulting mixed dispersion was heated from room temperature to 50° C. (at a temperature rise rate of 0.25° C./min) and then maintained at 50° C. for 2 h, thereby obtaining a dispersion containing aggregated particles having a volume median particle size of 2.96 μm and a CV value of 22.2.

Next, 120 g of the resin emulsion 1 (resin content: 23% by weight) were added at a rate of 2 g/min to the thus obtained dispersion maintained at 50° C., and then the resulting dispersion was further stirred for 20 min. This procedure was further repeated twice. Then, 120 g of the resin emulsion 1 (resin content: 23% by weight) and 120 g of a 6.4 wt % ammonium sulfate aqueous solution were simultaneously added at a rate of 2 g/min through different ports of the separable flask, and then the resulting dispersion was stirred for 20 min. This procedure was repeated one more time. As a result, after the elapse of 3 h, 2,638 g of an aggregated particle dispersion 2 containing aggregated particles having a volume median particle size of 4.09 μm and a CV value of 24.9 were obtained.

Aggregated Particle Dispersion Production Example 3

Production of Aggregated Particle Dispersion 3

A 5 L three-necked separable flask was charged with 1,000 g of the resin emulsion 2 (resin content: 23% by weight) at room temperature. Then, while stirring the resin emulsion with a paddle-shaped stirrer at a rate of 100 rpm, 65.6 g of the releasing agent dispersion 1 (wax content: 20% by weight) were added to and mixed with the resin emulsion. To the resulting dispersion were added 478 g of a 11.2 wt % ammonium sulfate aqueous solution as an aggregating agent at a rate of 8.0 g/min, and the obtained mixture was further stirred at room temperature for 20 min. Thereafter, the resulting mixed dispersion was heated from room temperature to 55° C. (at a temperature rise rate of 0.25° C./min) and then maintained at 55° C. for 1 h, thereby obtaining a dispersion containing aggregated particles having a volume median particle size of 4.55 μm and a CV value of 27.4.

Next, 100 g of the resin emulsion 2 (resin content: 23% by weight) were added at a rate of 2 g/min to the thus obtained dispersion maintained at 55° C., and then the resulting dispersion was stirred for 20 min. This procedure was further repeated four times, thereby obtaining 1,979 g of an aggregated particle dispersion 3 containing aggregated particles having a volume median particle size of 7.27 μm and a CV value of 27.6.

Functional Group-Containing Compound Production Example 1

Production of Glycidyl Group-Containing Polymer A

A flask equipped with a stirrer, a nitrogen gas inlet tube, a reflux condenser and a thermometer was charged with 32.0 g of glycidyl methacrylate ("BLENMER G" available from Nippon Oil & Fat Corp.), 68.0 g of methoxy PEG acrylate ("Am-90" available from Shin-Nakanura Kagaku Kogyo Co., Ltd.; average molar number of addition of EO: 9) and 79.4 g of methyl ethyl ketone ("Wako First Grade Methyl Ethyl Ketone" available from Wako Junyaku Kogyo Co., Ltd.), and the contents of the flask were mixed and stirred at a stirring speed of 150 rpm for 30 min while bubbling a nitrogen gas into the obtained solution at a rate of 200 mL/min. Thereafter, the flow rate of a nitrogen gas introduced into the flask was controlled to 150 mL/min, and then the contents of the flask were heated to 80° C. at which 20.0 g of a methyl ethyl ketone (MEK) solution containing 0.56 g of an azo-based polymerization initiator ("V-65B" available from Wako Junyaku Kogyo Co., Ltd.) were added thereto. The resulting mixture was continuously stirred at 79° C. for 6 h to thereby subject the mixture to polymerization reaction. After completion of the polymerization reaction, the heating was terminated, and the obtained reaction solution was mixed and diluted with 200 g of MEK. The resulting MEK solution of the polymer was dropped into 4.5 L of ethanol ("Cica First Grade Ethanol (99.5)" available from Kanto Kagaku Co., Ltd.). The resulting re-precipitated product was separated by filtration and then dried at 40° C. under a reduced pressure of 100 mmHg for 18 h, thereby obtaining a glycidyl group-containing polymer A. The thus obtained polymer A had a weight-average molecular weight of $2.09\times10^5$. Also, the content of a glycidyl group in the obtained polymer A was 2.81 mmol/g.

Functional Group-Containing Compound Production Example 2

Production of Glycidyl Group-Containing Polymer B

The same procedure as in Functional Group-Containing Compound Production Example 1 was repeated except that 68.0 g of methoxy PEG acrylate ("Am-90" available from Shin-Nakanura Chemical Co., Ltd.; average molar number of addition of EO: 9) were changed to 65.3 g of methoxy PEG acrylate ("TM-230"; average molar number of addition of EO: 23), and the glycidyl methacrylate ("BLENMER G" available from NOF Corporation was used in an amount of 34.7 g, thereby obtaining a glycidyl group-containing polymer B. The thus obtained polymer B had a weight-average molecular weight of $1.68\times10^5$. Also, the content of a glycidyl group in the obtained polymer B was 2.51 mmol/g.

Example 1

A 3 L three-necked separable flask was charged with 655 g of the aggregated particle dispersion 1 (amount of carboxyl group in polyester: 40.77 mmol) at room temperature. Then, while stirring with a paddle-shaped stirrer at a rate of 100 rpm, the dispersion was heated to 50° C. (at a rate of 1° C./min) and held at 50° C. for 2 h. Then, a solution obtained by diluting 9.45 g of "EPOCROSS WS-700" (available from Nippon Shokubai Co., Ltd.; content of oxazoline group in oxazoline group-containing polymer: 4.55 mmol/g; number-average molecular weight: 20,000; weight-average molecular weight: 40,000; 25% aqueous solution) (amount of oxazoline group in the solution: 10.75 mmol which was 0.26 time a molar amount of a carboxyl group in polyester; 2.3% by weight based on the resin binder) with 9.45 g of ion-exchanged water was added to the flask, followed by stirring the resulting dispersion for 10 min. Next, 165 g (1% by weight based on the resin) of a 0.63 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The thus obtained coalesced particles were cooled and subjected to solid-liquid separation by Nutsche-type suction filtration. The solid components thus separated were re-dispersed in 2 L of ion-exchanged water and then subjected to a filtering step two times. The resulting washed particles were vacuum-dried to obtain colored resin fine particles. The thus obtained colored resin fine particles were subjected to external addition treatment in which 2.5 parts of a hydrophobic silica ("RY50" available from Nippon Aerosil Co., Ltd.; number-average particle size: 0.04 μm), 1.0 part of a hydrophobic silica ("CAB-O-SIL TS-720" available from Cabot Corp.; number-average particle size: 0.012 μm) and 0.8 part of organic fine particles ("FINESFAIR P2000" available from Nippon Paint Co., Ltd.; number-average particle size: 0.5 μm) were externally added to 100 parts by weight of the colored resin fine particles using a Henschel mixer. The resulting particles were then allowed to pass through a 150 mesh sieve to separate the fine particle capable of passing through the sieve therefrom, thereby obtaining a cyan toner. The thus obtained cyan toner had a volume median particle size of 5.6 μm and a CV value of 28.0. The cyan toner was subjected to evaluation of a fusing ability and a heat-resistant storage property thereof. The results are shown in Table 1.

Example 2

A 3 L three-necked separable flask was charged with 655 g of the aggregated particle dispersion 1 (amount of carboxyl group in polyester: 40.77 mmol) at room temperature. Then, while stirring with a paddle-shaped stirrer at a rate of 100 rpm, the dispersion was heated to 50° C. (at a rate of 1° C./min) and held at 50° C. for 2 h. Then, a solution obtained by diluting 18.9 g of "EPOCROSS WS-700" (available from Nippon Shokubai Co., Ltd.; content of oxazoline group in oxazoline group-containing polymer: 4.55 mmol/g; number-average molecular weight: 20,000; 25% aqueous solution) (amount of oxazoline group in the solution: 21.50 mmol which was 0.53 time a molar amount of a carboxyl group in polyester; 4.6% by weight based on the resin binder) with 18.9 g of ion-exchanged water was added to the flask, followed by stirring the resulting dispersion for 10 min. Next, 149 g (1% by weight based on the resin) of a 0.69 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The thus obtained coalesced particles were subjected to filtration, washing, drying and external addition treatments in the same manner as in Example 1, thereby obtaining a cyan toner. The thus obtained cyan toner had a volume median particle size of 5.3 μm and a CV value of 26.7. The cyan toner was subjected to evaluation of a fusing ability and a heat-resistant storage property thereof. The results are shown in Table 1.

Example 3

A 3 L three-necked separable flask was charged with 659 g of the aggregated particle dispersion 2 (amount of carboxyl group in polyester: 40.77 mmol) at room temperature. Then, while stirring with a paddle-shaped stirrer at a rate of 100 rpm, the dispersion was heated to 50° C. (at a rate of 1° C./min) and held at 50° C. for 1.5 h. Then, 149 g (1% by weight based on the resin) of a 0.69 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The resulting coalesced particles had a volume median particle size of 4.5 μm. Next, a solution obtained by diluting 18.9 g of "EPOCROSS WS-700" (available from Nippon Shokubai Co., Ltd.; content of oxazoline group in oxazoline group-containing polymer: 4.55 mmol/g; number-average molecular weight: 20,000; 25% aqueous solution) (amount of oxazoline group in the solution: 21.50 mmol which was 0.53 time a molar amount of a carboxyl group in polyester; 4.6% by weight based on the resin binder) with 9.45 g of ion-exchanged water was added to the flask. The resulting dispersion was cooled to 63° C. (at a rate of 1° C./min) and stirred at 63° C. for 2 h, thereby obtaining coalesced particles. The thus obtained coalesced particles were subjected to filtration, washing, drying and external addition treatments in the same manner as in Example 1, thereby obtaining a cyan toner. The thus obtained cyan toner had a volume median particle size of 4.7 μm and a CV value of 28.8. The cyan toner was subjected to evaluation of a fusing ability and a heat-resistant storage property thereof. The results are shown in Table 1.

Example 4

A 3 L three-necked separable flask was charged with 300 g of the resin emulsion 1 (resin content: 23% by weight) at room temperature. Then, while stirring the resin emulsion with a paddle-shaped stirrer at a rate of 100 rpm, 19.7 g of the releasing agent dispersion 1 (wax content: 20% by weight) were added to and mixed with the resin emulsion. To the resulting dispersion was added a solution obtained by diluting 9.45 g of "EPOCROSS WS-700" (available from Nippon Shokubai Co., Ltd.; content of oxazoline group in oxazoline group-containing polymer: 4.55 mmol/g; number-average molecular weight: 20,000; 25% aqueous solution) (amount of oxazoline group in the solution: 10.75 mmol) with 9.45 g of ion-exchanged water, followed by adding 129 g of a 14.0 wt % ammonium sulfate aqueous solution as an aggregating agent thereto at a rate of 2.2 g/min. The obtained mixture was further stirred at room temperature for 20 min. Thereafter, the resulting mixed dispersion was heated from room temperature to 52° C. (at a temperature rise rate of 0.22° C./min) and then maintained at 50° C. for 4 h, thereby obtaining a dispersion containing aggregated particles having a volume median particle size of 2.71 μm and a CV value of 45.5. Next, 30 g of the resin emulsion 1 (resin content: 23% by weight) were added at a rate of 1 g/min to the thus obtained dispersion maintained at 52° C., and then the resulting dispersion was further stirred for 30 min. This procedure was further repeated twice. Then, 30 g of the resin emulsion 1 (resin content: 23% by weight) and 30 g of a 6.4 wt % ammonium sulfate aqueous solution were simultaneously added at a rate of 1 g/min through different ports of the separable flask, and then the resulting dispersion was stirred for 20 min. This procedure was repeated one more time, thereby obtaining an aggregated particle dispersion 4 containing aggregated particles having a volume median particle size of 3.97 μm and a CV value of 62.9. Then, 168 g (1% by weight based on the resin) of a 1.22 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, followed by stirring the mixture at 77° C. for 1.5 h to obtain coalesced particles. Then, the resulting coalesced particles were subjected to filtration, washing, drying and external addition treatments in the same manner as in Example 1, thereby obtaining a cyan toner. At this time, the amount of oxazoline group added was 0.26 time an amount of a carboxyl group in the polyester and 2.3% by weight on the basis of the resin binder. The thus obtained cyan toner had a volume median particle size of 6.0 μm and a CV value of 69.9. The cyan toner was subjected to evaluation of a fusing ability and a heat-resistant storage property thereof. The results are shown in Table 1.

Example 5

A 3 L three-necked separable flask was charged with 655 g of the aggregated particle dispersion 1 (amount of carboxyl group in polyester: 40.77 mmol) at room temperature. Then, while stirring with a paddle-shaped stirrer at a rate of 100 rpm, the dispersion was heated to 50° C. (at a rate of 1° C./min) and held at 50° C. for 2 h. Then, a solution obtained by diluting 1.89 g of the glycidyl group-containing polymer A obtained in Functional Group-Containing Compound Production Example 1 (amount of glycidyl group in polymer: 5.30 mmol which was 0.13 time a molar amount of carboxyl group in polyester and 1.4% by weight based on the resin binder) with 17.01 g of ion-exchanged water was added to the flask, followed by stirring the resulting dispersion for 10 min. Next, 165 g (1% by weight based on the resin) of a 0.63 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The thus obtained coalesced particles were cooled and subjected to solid-liquid separation by Nutsche-type suction filtration. The solid components thus separated were re-dispersed in 2 L of ion-exchanged water and then subjected to a filtering step two times. The resulting washed particles were vacuum-dried to obtain colored resin fine particles. The thus obtained colored resin fine particles were subjected to external addition treatment in which 2.5 parts of a hydrophobic silica ("RY50" available from Nippon Aerosil Co., Ltd.; average particle size: 0.04 μm), 1.0 part of a hydrophobic silica ("CAB-O-SIL TS-720" available from Cabot Corp.; average particle size: 0.012 μm) and 0.8 part of organic fine particles ("FINESFAIR P2000" available from Nippon Paint Co., Ltd.; average particle size: 0.5 μm) were externally added to 100 parts by weight of the colored resin fine particles using a Henschel mixer.

The resulting particles were then allowed to pass through a 150 mesh sieve to separate the fine particle capable of passing through the sieve therefrom, thereby obtaining a cyan toner. The thus obtained cyan toner had a volume median particle size of 6.1 μm and a CV value of 24.0. The cyan toner was subjected to evaluation of a fusing ability and a heat-resistant storage property thereof. The results are shown in Table 1.

Example 6

The same procedure as in Example 5 was repeated except for using 2.11 g of the glycidyl group-containing polymer B (amount of glycidyl group in polymer: 5.30 mmol which was 0.13 time a molar amount of carboxyl group in polyester and 1.2% by weight based on the resin binder) in place of 1.89 g of the glycidyl group-containing polymer A, thereby obtaining a cyan toner. The thus obtained cyan toner had a volume median particle size of 6.0 μm and a CV value of 23.7. The cyan toner was subjected to evaluation of a fusing ability and a heat-resistant storage property thereof. The results are shown in Table 1.

Comparative Example 1

A 3 L three-necked separable flask was charged with 655 g of the aggregated particle dispersion 1 (amount of carboxyl group in polyester: 40.77 mmol) at room temperature. Then, while stirring with a paddle-shaped stirrer at a rate of 100 rpm, the dispersion was heated to 50° C. (at a rate of 1° C./min) and held at 50° C. for 2 h. Then, 180 g (1% by weight based on the resin) of a 0.57 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The thus obtained coalesced particles were subjected to filtration, washing, drying and external addition treatments in the same manner as in Example 1, thereby obtaining a cyan toner. The thus obtained cyan toner had a volume median particle size of 5.8 μm and a CV value of 25.8. The cyan toner was subjected to evaluation of a fusing ability and a heat-resistant storage property thereof. The results are shown in Table 1. Meanwhile, in heat-resistant storage test, the resulting toner in the form of a cylindrical solid mass was still unbroken and not disintegrated even when loaded with a weight of 450 g, and remained in a solid mass condition.

Comparative Example 2

A 3 L three-necked separable flask was charged with 494 g of the aggregated particle dispersion 3 (amount of carboxyl group in polyester: 35.66 mmol) at room temperature. Then, while stirring with a paddle-shaped stirrer at a rate of 100 rpm, the dispersion was heated to 55° C. (at a rate of 1° C./min) and held at 55° C. for 1.3 h. Then, 153 g (1% by weight based on the resin) of a 0.56 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 77° C. (at a temperature rise rate of 1° C./min) and then held at 77° C. for 1.5 h, thereby obtaining coalesced particles. The thus obtained coalesced particles were subjected to filtration, washing, drying and external addition treatments in the same manner as in Example 1, thereby obtaining a cyan toner. The thus obtained cyan toner had a volume median particle size of 8.3 μm and a CV value of 31.4. The cyan toner was subjected to evaluation of a fusing ability and a heat-resistant storage property thereof. The results are shown in Table 1.

Comparative Example 3

A 3 L three-necked separable flask was charged with 494 g of the aggregated particle dispersion 3 (amount of carboxyl group in polyester: 35.66 mmol) at room temperature. Then, while stirring with a paddle-shaped stirrer at a rate of 100 rpm, the dispersion was heated to 55° C. (at a rate of 1° C./min) and held at 55° C. for 1.3 h. Then, a solution obtained by diluting 15.5 g of "EPOCROSS WS-700" (available from Nippon Shokubai Co., Ltd.; content of oxazoline group in oxazoline group-containing polymer: 4.55 mmol/g; number-average molecular weight: 20,000; 25% aqueous solution) (amount of oxazoline group in the solution: 17.63 mmol which was 0.49 time a molar amount of a carboxyl group in polyester; 4.6% by weight based on the resin binder) with 15.5 g of ion-exchanged water was added to the flask, followed by stirring the resulting dispersion for 10 min. Next, 126 g (1% by weight based on the resin) of a 0.68 wt % aqueous solution of an anionic surfactant ("EMAL E27C" available from Kao Corp.; $C_{12}H_{25}O(C_2H_4O)_2SO_3Na$) was added to the dispersion, and the resulting mixture was heated to 77° C. (at a temperature rise rate of 1° C./min) and then held at 77° C. for 1.5 h, thereby obtaining coalesced particles. The thus obtained coalesced particles were subjected to filtration, washing, drying and external addition treatments in the same manner as in Example 1, thereby obtaining a cyan toner. The thus obtained cyan toner had a volume median particle size of 7.8 μm and a CV value of 27.2. The cyan toner was subjected to evaluation of a fusing ability and a heat-resistant storage property thereof. The results are shown in Table 1.

TABLE 1

| | Examples | | | |
|---|---|---|---|---|
| | 1 | 2 | 3 | 4 |
| Aggregated particle dispersion | 1 | 1 | 2 | — |
| Functional group-containing compound | | | | |
| Functional group | Ox.*(i) | Ox.*(i) | Ox.*(i) | Ox.*(i) |
| Amount added*1 (times) | 0.26 | 0.53 | 0.53 | 0.26 |
| Amount added (wt % based on resin) | 2.3 | 4.6 | 4.6 | 2.3 |
| Time of addition | AA*(ii) | AA*(ii) | AC*(iii) | AE*(iv) |
| Particle size of resin particles upon addition ($D_{50}$; μm) | 5.0 | 5.0 | 4.5 | 0.15 |
| Toner | | | | |
| Particle size of toner ($D_{50}$; μm) | 5.6 | 5.3 | 4.7 | 6.0 |
| CV value | 28.0 | 26.7 | 28.8 | 69.9 |
| Circularity | 0.953 | 0.955 | 0.952 | 0.936 |
| Glass transition point (° C.) | 52.3 | 53.1 | 52.9 | 54.0 |
| Softening point (° C.) | 117 | 151 | 115 | 122 |
| Insoluble content (wt %) | 15.3 | 27.0 | 13.5 | 21.8 |
| Properties | | | | |
| Minimum fusing temperature (° C.) | 145 | 155 | 130 | 130 |
| Hot offset temperature (° C.) | 190 | ≧190 | 170 | 190 |
| Fusing temperature range (° C.) | 45 | ≧35 | 40 | 60 |
| Heat-resistant storage property | B | B | A | B |

| | Examples | | Comparative Examples | | |
|---|---|---|---|---|---|
| | 5 | 6 | 1 | 2 | 3 |
| Aggregated particle dispersion | 1 | 1 | 1 | 3 | 3 |
| Functional group-containing compound | | | | | |
| Functional group | Gly.*(v) | Gly.*(v) | — | — | Ox.*(i) |
| Amount added*1 (times) | 0.13 | 0.13 | — | — | 0.49 |
| Amount added (wt % based on resin) | 1.4 | 1.2 | — | — | 4.6 |
| Time of addition | AA*(ii) | AA*(ii) | — | — | AA*(ii) |
| Particle size of resin particles upon addition ($D_{50}$; μm) | 5.4 | 5.0 | 5.0 | 7.3 | 7.3 |
| Toner | | | | | |
| Particle size of toner ($D_{50}$; μm) | 6.1 | 6.0 | 5.8 | 8.3 | 7.8 |
| CV value | 24.0 | 23.7 | 25.8 | 31.4 | 27.2 |
| Circularity | 0.955 | 0.950 | 0.943 | 0.946 | 0.944 |
| Glass transition point (° C.) | 55.0 | 53.4 | 51.2 | 57.6 | 56.8 |
| Softening point (° C.) | 115 | 112 | 101 | 101 | 113 |
| Insoluble content (wt %) | 18.2 | 11.3 | 3.0 | 3.3 | 11.7 |
| Properties | | | | | |
| Minimum fusing temperature (° C.) | 140 | 140 | 135 | None | None |
| Hot offset temperature (° C.) | 165 | 170 | 145 | 140 | 145 |

TABLE 1-continued

| | | | | | |
|---|---|---|---|---|---|
| Fusing temperature range (° C.) | 25 | 30 | 10 | None | None |
| Heat-resistant storage property | B | B | C | B | A |

Note

*[1]Ratio of the number of moles of functional group capable of reacting with carboxyl group to the number of moles of carboxyl group in polyester

*[(i)]Ox.: Oxazoline group;

*[(ii)]AA: After aggregation;

*[(iii)]AC: After coalescence;

*[(iv)]AE: After emulsification but before aggregation

*[(v)]Gly.: Glycidyl

Toner Kneaded Material Production Example 1

Production of Toner Kneaded Material A

The following raw materials were mixed with each other using a 20 L Henschel mixer at a stirring speed of 1500 r/m for 3 min, and then melt-kneaded using an open roll-type continuous kneader "KNEADEX" (available from Mitsui Mining Co., Ltd.), thereby obtaining a toner kneaded material. The thus obtained toner kneaded material was cooled on a cooling belt, and then coarsely crushed using a mill having a 2 minϕ screen to obtain a toner kneaded material A. The thus obtained toner kneaded material A had a softening point of 110° C., a glass transition point of 65° C. and an acid value of 22.3.

(Raw Materials)

Polyester A: 4550 g

Polyester B: 2450 g

Carnauba Wax No. 1 (available from S. KATO & Company; melting point: 83° C.): 350 g "ECB-301" (copper phthalocyanine pigment available from Dainichiseika Color & Chemicals Mtg. Co., Ltd.): 350 g Meanwhile, the open roll-type continuous kneader used in this Example had a roll outer diameter of 0.14 m and an effective roll length of 0.8 m, and operated under the conditions including a heating roll (front roll) rotational speed of 33 m/min, a cooling roll (rear roll) rotational speed of 22 m/min and a gap between rolls of 0.1 mm. The temperatures of a heating medium and a cooling medium flowing through an inside of the respective rolls were adjusted to 150° C. on a raw material charging side of the heating roll, 130° C. on a kneaded material discharging side of the heating roll, 35° C. on a raw material charging side of the cooling roll, and 30° C. on a kneaded material discharging side of the cooling roll. The mixture of the raw materials was supplied at a feed speed of 5 kg/h, and the average residence time thereof in the kneader was about 5 min.

Toner Kneaded Material Production Example 2

Production of Toner Kneaded Material B

The same procedure as in Toner Kneaded Material Production Example 1 for production of the toner kneaded material A was repeated except for using a paraffin wax "HNP-9" (available from Nippon Seiro Co., Ltd.; melting point: 78° C.) in place of the carnauba wax, thereby obtaining a toner kneaded material B. The thus obtained toner kneaded material B had a softening point of 107° C. and a glass transition point of 66° C.

Toner Kneaded Material Production Example 3

Production of Toner Kneaded Material C

The same procedure as in Toner Kneaded Material Production Example 1 for production of the toner kneaded material A was repeated except for using an ester wax "WEP-3" (available from NOF Corp.; melting point: 83° C.) in place of the carnauba wax, thereby obtaining a toner kneaded material C. The thus obtained toner kneaded material C had a softening point of 106° C. and a glass transition point of 67° C.

Releasing Agent-Containing Resin Emulsion Production Example 1

Production of Releasing Agent-Containing Resin Emulsion A

A 5 L stainless steel flask was charged with 330 g of the toner kneaded material A, 3.0 g of a nonionic surfactant ("EMALGEN 430" available from Kao Corp.; polyoxyethylene (26 mol) oleyl ether), 20.0 g of an anionic surfactant ("NEOPELEX G-15" available from Kao Corp.; 15 wt % aqueous solution of sodium dodecylbenzenesulfonate) and 139 g (amount capable of neutralizing 100% of the toner kneaded material) of a potassium hydroxide aqueous solution (as a neutralizing agent; concentration: 5% by weight), and the contents of the flask were melted at 95° C. for 2 h while stirring with a paddle-shaped stirrer at a rate of 200 rpm. Successively, while stirring with a paddle-shaped stirrer at a rate of 200 rpm, 571 g in total of deionized water were dropped into the flask at a rate of 3 g/min to prepare a resin dispersion. Finally, the obtained resin dispersion was cooled to room temperature and passed through a wire mesh having a 200 mesh screen (opening: 105 μm) to obtain an emulsion of finely divided resin particles having a resin content of 29% by weight. The primary particles of the resin fine particles had a volume median particle size ($D_{50}$) of 0.163 μm and a coefficient of variation of particle size distribution (CV value) of 28. No residual components remained on the wire mesh. The thus obtained emulsion was mixed with ion-exchanged water to control a resin content therein to 23% by weight, thereby obtaining a releasing agent-containing resin emulsion A.

Releasing Agent-Containing Resin Emulsion Production Examples 2 and 3

Production of Releasing Agent-Containing Resin Emulsions B and C

The same procedure as in Releasing Agent-Containing Resin Emulsion Production Example 1 was repeated except for using each of the toner kneaded materials B and C in place of the toner kneaded material A, thereby obtaining the corresponding releasing agent-containing resin emulsions B and C, respectively.

Example 7

Three hundred sixty grams of the releasing agent-containing resin emulsion A were mixed in a 2 L container at room temperature. Then, 194.5 g of a 9.8 wt % ammonium sulfate aqueous solution as an aggregating agent were added to the container while stirring with a paddle-shaped stirrer at a rate of 100 rpm, and the contents of the container were further stirred at room temperature for 60 min. Thereafter, the resulting mixed dispersion was heated from room temperature to 55° C. (at a temperature rise rate of 0.25° C./min), and allowed to stand at 55° C. for 5 h, thereby obtaining an aggregated particle dispersion containing aggregated particles having a volume median particle size ($D_{50}$) of 5.0 μm.

To the aggregated particle dispersion maintained at 55° C. were added 4.0 g of "EPOCROSS WS-700" (oxazoline-containing polymer available from Nippon Shokubai Co., Ltd.; the amount of oxazoline group therein was 0.125 time an amount of a carboxyl group in the polyester contained in the releasing agent-containing resin emulsion), followed by stirring the resulting dispersion for 15 min.

Next, 173 g of a 2.8 wt % aqueous solution of an anionic surfactant ("EMAL E27C" available from Kao Corp.) were added to the dispersion, and the resulting mixture was heated to 80° C. (at a temperature rise rate of 0.25° C./min) and then held at 80° C. for 1 h, thereby obtaining coalesced particles. The thus obtained coalesced particles were cooled to room temperature and then subjected to a suction filtration step, a washing step and a drying step, thereby obtaining toner particles.

The thus obtained toner particles were subjected to external addition treatment in which 2.5 parts of a hydrophobic silica ("RY50" available from Nippon Aerosil Co., Ltd.; number-average particle size: 0.04 μm) and 1.0 part of a hydrophobic silica ("CAB-O-SIL TS-720" available from Cabot Corp.; number-average particle size: 0.012 μm) were externally added to 100 parts by weight of the toner particles using a Henschel mixer. The resulting particles were then allowed to pass through a 150 mesh sieve to separate the fine particle capable of passing through the sieve therefrom, thereby obtaining a cyan toner. The thus obtained cyan toner had a volume median particle size of 5.1 μm and a CV value of 26. The cyan toner was subjected to evaluation of a fusing ability and a heat-resistant storage property thereof. The results are shown in Table 2.

Example 8

Three hundred sixty grams of the releasing agent-containing resin emulsion A and 4.0 g of "EPOCROSS WS-700" (oxazoline group-containing polymer available from Nippon Shokubai Co., Ltd.; the amount of oxazoline group therein was 0.125 time an amount of a carboxyl group in the polyester contained in the releasing agent-containing resin emulsion) were mixed in a 2 L container at room temperature. Then, 194.5 g of a 9.8 wt % ammonium sulfate aqueous solution as an aggregating agent were added to the container while stirring with a paddle-shaped stirrer at a rate of 100 rpm, and the contents of the container were further stirred at room temperature for 60 min. Thereafter, the resulting mixed dispersion was heated from room temperature to 55° C. (at a temperature rise rate of 0.25° C./min), and then held at 55° C. for 5 h, thereby obtaining aggregated particles having a volume median particle size ($D_{50}$) of 5.1 μm.

Next, 173 g of a 2.8 wt % aqueous solution of an anionic surfactant ("EMAL E27C" available from Kao Corp.) were added to the dispersion, and the resulting mixture was heated to 80° C. (at a temperature rise rate of 0.25° C./min) and then held at 80° C. for 1 h, thereby obtaining coalesced particles. The thus obtained coalesced particles were cooled to room temperature and then subjected to a suction filtration step, a washing step and a drying step, thereby obtaining toner particles.

The thus obtained toner particles were subjected to external addition treatment in which 2.5 parts of a hydrophobic silica ("RY50" available from Nippon Aerosil Co., Ltd.; number-average particle size: 0.04 μm) and 1.0 part of a hydrophobic silica ("CAB-O-SIL TS-720" available from Cabot Corp.; number-average particle size: 0.012 μm) were externally added to 100 parts by weight of the toner particles using a Henschel mixer. The resulting particles were then allowed to pass through a 150 mesh sieve to separate the fine particle capable of passing through the sieve therefrom, thereby obtaining a cyan toner. The thus obtained cyan toner had a volume median particle size of 5.9 μm and a CV value of 26. The cyan toner was subjected to evaluation of a fusing ability and a heat-resistant storage property thereof. The results are shown in Table 2.

Example 9

The same procedure as in Example 7 was repeated except for using the releasing agent-containing resin emulsion B in place of the releasing agent-containing resin emulsion A, thereby producing a cyan toner. The resulting cyan toner was subjected to evaluation of a fusing ability and a heat-resistant storage property thereof. The results are shown in Table 2.

Example 10

The same procedure as in Example 7 was repeated except for using the releasing agent-containing resin emulsion C in place of the releasing agent-containing resin emulsion A, thereby producing a cyan toner. The resulting cyan toner was subjected to evaluation of a fusing ability and a heat-resistant storage property thereof. The results are shown in Table 2.

Comparative Example 4

The same procedure as in Example 7 was repeated except for adding no oxazoline group-containing compound, thereby producing a cyan toner. The resulting cyan toner was subjected to evaluation of a fusing ability and a heat-resistant storage property thereof. The results are shown in Table 2.

TABLE 2

| | Ex. 7 | Ex. 8 | Ex. 9 | Ex. 10 | Comp. Ex. 4 |
|---|---|---|---|---|---|
| Releasing agent | CW*(c) | CW*(c) | PW*(d) | EW*(e) | CW*(c) |
| Melting point of releasing agent (° C.) | 83 | 83 | 78 | 83 | 83 |
| Releasing agent-containing resin emulsion | A | A | B | C | A |
| Molar ratio*(a) | 0.13 | 0.13 | 0.13 | 0.13 | 0 |
| Mixing temperature*(b) | 80 | 80 | 80 | 80 | — |
| Time of addition of oxazoline group-containing polymer*1 | *(f) | *(g) | *(f) | *(f) | — |
| Particle size of toner (μm) | 5.1 | 5.9 | 4.5 | 4.7 | 5.0 |
| CV (%) | 26 | 26 | 30 | 29 | 23 |
| Circularity | 0.95 | 0.94 | 0.95 | 0.95 | 0.96 |
| Insoluble content (%) | 13 | 21 | 11 | 10 | 3 |
| Glass transition point of toner (° C.) | 54.6 | 58.8 | 56.8 | 55.0 | 52.8 |
| Softening point of toner (° C.) | 113 | 116 | 112 | 110 | 102 |
| Minimum fusing temperature of toner (° C.) | 140 | 140 | 140 | 140 | 140 |
| Hot offset temperature of toner (° C.) | 180 | 180 | 165 | 160 | 140 |
| Fusing temperature range (° C.) | 40 | 40 | 25 | 20 | 0 |

TABLE 2-continued

| | Ex. 7 | Ex. 8 | Ex. 9 | Ex. 10 | Comp. Ex. 4 |
|---|---|---|---|---|---|
| Heat-resistant storage property of toner | B | B | B | B | C |

Note

*[1]Time of addition of oxazoline group-containing polymer (1) At the step of melt-kneading toner raw materials including a polyester-containing resin binder and a releasing agent (2) At the step of emulsifying a melt-kneaded material obtained in the step (1) in an aqueous medium (3) At the step of aggregating emulsified particles contained in an emulsion obtained in the step (2)

(4) At the step of coalescing aggregated particles obtained in the step (3)

*[(a)]Ratio of (number of moles of oxazoline group in oxazoline group-containing polymer)/(number of moles of carboxyl group in resin);

*[(b)]Temperature upon mixing oxazoline group-containing polymer with aggregated particles or resin particles;

*[(c)]CW: Carnauba wax;

*[(d)]PW: Paraffin wax "HNP-9";

*[(e)]EW: Ester wax "WEP-3";

*(f): After step (B) but before step (C);

*(g) After step (A) but before step (B)

Resin Emulsion Production Example 3

Production of Resin Emulsion 3

A mixed resin composed of 975 g of the polyester A and 525 g of the polyester B (the mixed resin obtained by mixing the polyester A and the polyester B at such a mixing ratio had a softening point of 114° C., a glass transition point of 66° C. and an acid value of 23 mgKOH/g), 112.5 g of a dimethyl quinacridone pigment ("ECR-186Y" available from Dainichiseika Color & Chemicals Mtg. Co., Ltd.), 15 g of a nonionic surfactant ("EMALGEN 430" available from Kao Corp.), 100 g of an anionic surfactant ("NEOPELEX G-15" available from Kao Corp.; 15 wt % aqueous solution of sodium dodecylbenzenesulfonate) and 850 g of a potassium hydroxide aqueous solution (as a neutralizing agent; concentration: 5% by weight) were charged into a 5 L stainless steel flask, and melted at 98° C. for 2 h while stirring with a paddle-shaped stirrer at a rate of 200 rpm, thereby obtaining a resin binder mixture. Next, while stirring with a paddle-shaped stirrer at a rate of 200 rpm, 2600 g in total of deionized water were dropped into the flask at a rate of 15 g/min, thereby preparing a resin emulsion. Finally, the obtained resin emulsion was cooled to room temperature and then passed through a wire mesh having a 200 mesh screen (opening: 105 μm) to obtain an emulsion containing finely divided resin particles having a resin content of 32% by weight.

The primary particles of the resulting resin fine particles had a volume median particle size ($D_{50}$) of 0.25 μm, a softening point of 105° C. and a glass transition point of 59° C. No residual components remained on the wire mesh. The thus obtained emulsion was mixed with ion-exchanged water to control a resin content therein to 23% by weight, thereby obtaining a resin emulsion 3.

Releasing Agent Dispersion Production Example 2

Production of Releasing Agent Dispersion 2

After dissolving 3.6 g of an aqueous solution of dipotassium alkenyl (mixture of hexadecenyl group and octadecenyl group) succinate ("LATEMUL ASK" available from Kao Corp.; concentration of effective ingredients: 28% by weight) in 400 g of deionized water in a 1 L beaker, 100 g of a carnauba wax (available from KATO & Company; melting point: 85° C.) were dispersed in the resultant solution. While maintaining the obtained dispersion at a temperature of 90 to 95° C., the dispersion was subjected to dispersing treatment for 60 min using "Ultrasonic Homogenizer 600W" (available from Nippon Seiki Co., Ltd.) and then cooled to room temperature. The resulting releasing agent emulsified particles had a volume median particle size ($D_{50}$) of 0.47 μm and a coefficient of variation of particle size distribution (CV value) of 26. The thus obtained dispersion was mixed with ion-exchanged water to control a wax content therein to 20% by weight, thereby obtaining a releasing agent dispersion 2.

Example 11

Production of Aggregated Particle Dispersion

A 10 L three-necked separable flask was charged with 3823 g of the resin emulsion 3 (resin binder content: 23% by weight) at room temperature. Then, while stirring the resin emulsion with a paddle-shaped stirrer at a rate of 100 rpm, 250 g of the releasing agent dispersion 2 (wax content: 20% by weight) were added to and mixed with the resin emulsion. To the resulting dispersion were added 1858 g of a 11.2 wt % ammonium sulfate aqueous solution as an aggregating agent at a rate of 30 g/min, and the obtained mixture was further stirred at room temperature for 20 min. Thereafter, the resulting mixed dispersion was heated from room temperature to 55° C. (at a temperature rise rate of 0.25° C./min) and then held at 55° C., thereby obtaining a dispersion containing aggregated particles having a volume median particle size of 4.1 μm.

Next, 382 g of the resin emulsion 3 (resin content: 23% by weight) were added at a rate of 12.5 g/min (addition rate of 0.42 part by weight/min based on 100 parts by weight of resin components constituting the core (aggregated) particles) to the thus obtained dispersion maintained at 55° C., and then the resulting dispersion was stirred for 20 min. This procedure was further repeated twice. Then, 382 g of the resin emulsion 3 (resin binder content: 23% by weight) and 291 g of a 6.4 wt % ammonium sulfate aqueous solution were simultaneously added at a rate of 12.5 g/min through different ports of the separable flask, and then the resulting dispersion was stirred for 20 min. This procedure was repeated one more time, thereby obtaining an aggregated particle dispersion.

Production of Toner Particles

Next, while stirring with a paddle-shaped stirrer at a rate of 100 rpm, the resulting aggregated particle dispersion was heated to 50° C. (at a rate of 1° C./min) and then held at 50° C. for 2 h. To the dispersion were added 12.5 g of "EPOCROSS WS-700" (available from Nippon Shokubai Co., Ltd.; content of oxazoline group in oxazoline group-containing polymer: 4.55 mmol/g; number-average molecular weight: 20,000; weight-average molecular weight: 40,000; 25% aqueous solution) (amount of oxazoline group in aqueous solution: 14.2 mmol which was 0.26 time a molar amount of a carboxyl group in polyester), and the resulting dispersion was stirred for 10 min. Then, 1256 g (2.4% by weight based on the resin binder) of a 2.8 wt % aqueous solution of an anionic surfactant ("EMAL E27C" available from Kao Corp.; $C_{12}H_{25}O(C_2H_4O)_2SO_3Na$) were added to the dispersion, and the resulting mixture was heated to 80° C. (at a temperature rise rate of 1° C./min) and then held at 80° C. for 1.5 h to obtain coalesced particles. Then, the resulting coalesced particles were cooled and charged into a centrifugal dehydrator ("Centrifugal Separator H-122" available from KOKUSAN Co., Ltd.). While subjecting the coalesced particles to centrifugal separation at a peripheral speed of 47 m/s (rotational speed: 3000 rpm; diameter: 30 cm), the coalesced particles were washed by adding and mixing deionized water therein at a rate of 6±0.5 L per 100 g of the resin in the coalesced particles. Thereafter, the centrifugal dehydrator was further rotated for 1 h to reduce a water content in the toner, and then the toner was allowed to stand in a vacuum dryer maintained at 40° C. for drying the toner, thereby obtaining toner particles having a volume median particle size of 4.8 μm.

External Addition Treatment

Four hundred parts by weight of the thus obtained toner particles were mixed with the external additive having a composition and properties as shown in Table 3 at proportions as shown in Table 4 using a 5 L Henschel mixer operated at a rate of 35 m/s (rotational speed: 3700 rpm; diameter of agitation blade: 18 cm) for 180 s, and then the resulting mixture was passed through an ultrasonic sieve (150 mesh) to separate the fine particles capable of passing through the sieve therefrom, thereby producing a magenta toner. The thus obtained magenta toner was subjected to evaluation of heat-resistant storage property thereof, and further loaded into the above printer to evaluate a developability as well as a charge amount on a developing roller. In addition, it was confirmed that the toner was a negative charging toner. The results are shown in Table 4.

Examples 12 to 17

The same procedure as in Example 11 was repeated except for changing the external additives to those as shown in Table 4, thereby producing respective magenta toners. The thus obtained respective magenta toners were subjected to evaluation of heat-resistant storage property thereof, and further loaded into the above printer to evaluate a developability as well as a charge amount on a developing roller. In addition, it was confirmed that these toners were a negative charging toner. The results are shown in Table 4.

Comparative Example 5

The toner particles were produced in the same manner as in Example 11 except for adding no "EPOCROSS WS-700". The toner particles were dried and then mixed with the external additive as shown in Table 4, thereby producing a magenta toner. The thus obtained magenta toner was subjected to evaluation of heat-resistant storage property thereof, and further loaded into the above printer to evaluate a developability as well as a charge amount on a developing roller. In addition, it was confirmed that the toner was a negative charging toner. The results are shown in Table 4.

TABLE 3

| | Base material | Surface-treating agent (weight ratio) | Specific surface area ($m^2/g$) | Particle size (nm) | Charge amount (μC/g) | Polarity (charging property) |
|---|---|---|---|---|---|---|
| A | Magnesium oxide [1] | Aminosilane/silicone oil = 50/50 | 31 | 45 | +200 | Positive |
| B | Silica [2] | Dimethyl dichlorosilane | 120 | 16 | −23 | Negative |
| C | Silica [3] | Aminosilane | 40 | 50 | +17 | Positive |
| D | Silica [4] | Aminosilane/octyl silane = 50/50 | 31 | 80 | +61 | Positive |
| E | Alumina [5] | Aminosilane/silicone oil = 50/50 | 110 | 13 | +15 | Positive |
| F | Organic fine particles [6] | — | 5 | 500 | +71 | Positive |

Note
[1] Magnesium oxide (commercially available product)
[2] Silica (tradename "R972" available from Nippon Aerosil Co., Ltd.)
[3] Silica (tradename "HDK H05TA" available from Wacker-Chemie Corp.)
[4] Silica (commercially available product)
[5] Alumina (commercially available product)
[6] Organic fine particles (tradename "P-2000" available from Nippon Paint Co., Ltd.)

TABLE 4

| | External additive (wt %: based on toner) | | | |
|---|---|---|---|---|
| | Functional group-containing compound | Particles with number-average particle size of from 10 to 200 nm | Particles with number-average particle size of from 6 to 30 nm | Others |
| Example 11 | Oxazoline compound | Magnesium oxide A: 1.1% | Silica B: 1.5% | Organic fine particles F: 0.8% |
| Example 12 | Oxazoline compound | Magnesium oxide A: 1.6% | Silica B: 1.5% | Organic fine particles F: 0.8% |
| Example 13 | Oxazoline compound | Magnesium oxide A: 0.6% | Silica B: 1.5% | Organic fine particles F: 0.8% |
| Example 14 | Oxazoline compound | — | Silica B: 1.5% | Organic fine particles F: 0.8% |
| Example 15 | Oxazoline compound | Silica D: 1.3% | Silica B: 1.5% | Organic fine particles F: 0.8% |
| Example 16 | Oxazoline compound | Silica C: 0.7% | Silica B: 1.5% | Organic fine particles F: 0.8% |
| Example 17 | Oxazoline compound | — | Silica E: 0.4% Silica B: 1.5% | Organic fine particles F: 0.8% |
| Comp. Ex. 5 | None | Magnesium oxide A: 1.1% | Silica B: 1.5% | Organic fine particles F: 0.8% |

| | Charge amount on developing roller (μC/g) | OPC fogging (ΔE) | Heat-resistant storage property | Minimum fusing temperature (° C.) | Hot offset temperature (° C.) |
|---|---|---|---|---|---|
| Example 11 | −56 | 2 | A | 140 | 165 |
| Example 12 | −74 | 2 | A | 140 | 165 |
| Example 13 | −55 | 3 | A | 140 | 165 |
| Example 14 | −23 | 5 | B | 140 | 165 |
| Example 15 | −45 | 3 | B | 140 | 165 |
| Example 16 | −31 | 6 | B | 140 | 165 |
| Example 17 | −25 | 11 | B | 140 | 165 |
| Comp. Ex. 5 | −63 | 1 | C | 130 | 135 |

Industrial Applicability

The toner produced according to the production process of the present invention can be suitably used as a toner for electrophotography which is employed in electrophotographic method, electrostatic recording method, electrostatic printing method, etc.

What is claimed is:

1. A process for producing a toner, comprising:

(A) emulsifying a resin binder comprising a polyester having a constitutional unit derived from a trivalent or higher-valent carboxylic acid in an aqueous medium, to obtain an emulsion comprising emulsified particles;

(B) aggregating said emulsified particles, to obtain aggregated particles; and (C) coalescing said aggregated particles, to obtain toner particles, said process further comprising (a) and (b), which are to be conducted after said emulsifying:

(a) adding a compound having at least one functional group selected from the group consisting of an oxazoline group and a glycidyl group; and (b) chemically bonding said compound having said at least one functional group and said resin binder comprising said polyester.

2. The process according to claim 1, wherein said emulsifying comprises: (1) melt-kneading toner raw materials comprising said resin binder comprising said polyester and a releasing agent together, to obtain a melt-kneaded material; and (2) emulsifying said melt-kneaded material in an aqueous medium.

3. The process according to claim 2, wherein said melt-kneading is carried out with an open roll-type kneader, a twin-screw continuous kneader, or a roll mill-type batch kneader.

4. The process according to claim 1, wherein said process further comprises (D) which is to be conducted after said coalescing:

(D) subjecting said toner particles to external addition treatment with an external additive comprising magnesium oxide having a positive charging property and a number-average particle size of from 10 to 200 nm and silica or titanium oxide having a number-average particle size of from 6 to 30 nm.

5. The process according to claim 4, wherein said magnesium oxide is hydrophobilized with an aminosilane.

6. The process according to claim 4, wherein a ratio of a content of the magnesium oxide to a content of the silica or titanium oxide (content of magnesium oxide/content of silica or titanium oxide) is from 0.4 to 1.5 in terms of a weight ratio therebetween.

7. The process according to claim 1, wherein said compound having at least one functional group selected from the group consisting of an oxazoline group and a glycidyl group is present in such an amount that the number of moles of the functional group contained in the compound is from 0.01 to 0.8 times the number of moles of the carboxyl group contained in the resin binder comprising the polyester.

8. The process according to claim 1, wherein said chemically bonding is carried out after said aggregating.

9. The process according to claim 1, wherein said chemically bonding is carried out while maintaining a temperature of from 50 to 90° C. for a period of from 0.5 to 5 hours.

10. The process according to claim 1, wherein a carboxylic acid component for forming said polyester comprises said trivalent or higher-valent carboxylic acid in an amount of from 1 to 80% by weight.

11. The process according to claim 1, wherein an alcohol component for forming said polyester comprises an alkyleneoxide adduct of bisphenol A.

12. The process according to claim 5, wherein a ratio of a content of the magnesium oxide to a content of the silica or titanium oxide (content of magnesium oxide/content of silica or titanium oxide) is from 0.4 to 1.5 in terms of a weight ratio therebetween.

13. The process according to claim 2, wherein said process further comprises (D) which is to be conducted after said coalescing:

(D) subjecting said toner particles to external addition treatment with an external additive comprising magnesium oxide having a positive charging property and a number-average particle size of from 10 to 200 nm and silica or titanium oxide having a number-average particle size of from 6 to 30 nm.

14. The process according to claim 13, wherein said magnesium oxide is hydrophobilized with an aminosilane.

15. The process according to claim 13, wherein a ratio of a content of the magnesium oxide to a content of the silica or titanium oxide (content of magnesium oxide/content of silica or titanium oxide) is from 0.4 to 1.5 in terms of a weight ratio therebetween.

16. The process according to claim 7, wherein said process further comprises (D) which is to be conducted after said coalescing:

(D) subjecting said toner particles to external addition treatment with an external additive comprising magnesium oxide having a positive charging property and a number-average particle size of from 10 to 200 nm and silica or titanium oxide having a number-average particle size of from 6 to 30 nm.

17. The process according to claim 16, wherein said magnesium oxide is hydrophobilized with an aminosilane.

18. The process according to claim 16, wherein a ratio of a content of the magnesium oxide to a content of the silica or titanium oxide (content of magnesium oxide/content of silica or titanium oxide) is from 0.4 to 1.5 in terms of a weight ratio therebetween.

* * * * *